US005256130A

United States Patent [19]

Kachel et al.

[11] Patent Number: 5,256,130

[45] Date of Patent: Oct. 26, 1993

[54] REINFORCED PAPER OFFICE SUPPLIES AND METHOD OF MAKING THEM

[75] Inventors: Theodore V. Kachel, Purchase, N.Y.; Jonathan B. Rivlin, East Brunswick, N.J.; Lee A. Boy, Jamestown, N.C.; Robert E. Hawes, Jr., Huntington Bay, N.Y.; Cheryl Dellacroce-Steinberg, Jericho, N.Y.; Eric Aaldenberg, Bayside, N.Y.; James J. Lynch, Berkley Heights, N.J.

[73] Assignee: Esselte Pendaflex Corporation, Garden City, N.Y.

[21] Appl. No.: 859,183

[22] Filed: Mar. 27, 1992

Related U.S. Application Data

[63] Continuation-in-part of Ser. No. 769,001, Sep. 30, 1991, which is a continuation of Ser. No. 483,094, Feb. 21, 1990, Pat. No. 5,066,045.

[51] Int. Cl.[5] ..... B31B 1/90

[52] U.S. Cl. ..... 493/210; 493/267; 493/947; 493/379

[58] Field of Search ..... 493/210, 267, 379, 344, 493/84, 116, 117, 947, 89, 379, 380, 381, 344, 345, 346

[56] References Cited

U.S. PATENT DOCUMENTS

| | | | |
|---|---|---|---|
| 282,275 | 7/1883 | Cooke | 229/72 X |
| 325,676 | 9/1885 | Jenkins | 229/72 X |
| 510,350 | 12/1893 | Lochmann | 229/72 X |
| 574,974 | 1/1897 | Wiley . | |
| 821,019 | 5/1906 | Cooke . | |
| 1,116,383 | 11/1914 | Case . | |
| 1,150,034 | 8/1915 | Hub . | |
| 1,273,960 | 7/1918 | Wagemaker . | |
| 1,455,419 | 5/1923 | Ahquist . | |
| 1,585,237 | 5/1926 | Doughty . | |
| 1,622,753 | 3/1927 | Ahlquist . | |
| 1,634,450 | 7/1927 | Bushnell . | |
| 1,650,051 | 1/1927 | Smith . | |
| 1,691,773 | 11/1928 | Maclean | 493/379 |
| 1,698,841 | 1/1929 | Doughty . | |
| 1,734,642 | 11/1929 | Olm | 493/947 |
| 1,743,191 | 1/1930 | Charlton . | |
| 1,745,249 | 1/1930 | Doughty . | |
| 1,757,122 | 5/1930 | Hunter . | |
| 1,802,429 | 4/1931 | Josephson . | |
| 1,868,188 | 7/1932 | Barker . | |
| 1,883,938 | 10/1932 | Killeffer | 493/116 |
| 1,891,558 | 12/1932 | Rupf . | |
| 1,956,325 | 4/1934 | Hart . | |
| 2,043,110 | 6/1936 | McLaurin | 493/116 |
| 2,052,623 | 9/1936 | Harby | 93/1 |
| 2,062,436 | 12/1936 | Yawman | 129/16.8 |
| 2,179,126 | 11/1939 | Klotz | 150/1.6 |
| 2,188,730 | 1/1940 | Swab . | |
| 2,264,295 | 12/1941 | Carter | 129/16.7 |
| 2,291,724 | 8/1942 | Jonas | 129/16.7 |

(List continued on next page.)

FOREIGN PATENT DOCUMENTS

| | | |
|---|---|---|
| 563159 | 12/1957 | Belgium . |
| 630978 | 11/1963 | Belgium . |
| 1216486 | 1/1987 | Canada . |

(List continued on next page.)

OTHER PUBLICATIONS

"WIMP?" Brochure, Smead Manufacturing Co.

Quill's Semi-Annual Office Products Catalog of May, 1991, p. 62F.

Smead Catalog No. 89, 1988, pp. 37, 38.

Ames Color-File Media Products and Accessories Catalog, 1991, pp. 2,3 6, 12, 34.

*Primary Examiner*—Bruce M. Kisliuk

*Assistant Examiner*—Jack Lavinder

*Attorney, Agent, or Firm*—Pennie & Edmonds

[57] ABSTRACT

A method for manufacturing improved paper office supplies comprises determining which critical areas or portions of the office supplies are prone to wear and tear, and applying reinforcement upon or adjacent to those critical areas or portions to increase the strength and resistance of the office supplies to such wear and tear. This invention also provides some examples of reinforced paper office supplies.

84 Claims, 16 Drawing Sheets

U.S. PATENT DOCUMENTS

| | | | |
|---|---|---|---|
| 2,304,385 | 12/1942 | Sussman | 281/34 |
| 2,330,402 | 9/1943 | Winokar | 229/72 |
| 2,460,909 | 2/1949 | Shaffer | 229/68 |
| 2,507,659 | 5/1950 | Zalkind | 40/23 |
| 2,519,405 | 8/1950 | Schwinger | 229/72 |
| 2,797,801 | 7/1957 | Bishop | 206/56 |
| 2,863,998 | 2/1975 | Grundell | 312/184 |
| 2,893,144 | 7/1959 | Cunningham | 40/23 |
| 3,063,619 | 11/1952 | Rhoten | 229/68 |
| 3,073,508 | 1/1963 | Hiersteiner | 229/68 |
| 3,198,420 | 3/1965 | Hiersteinet | 229/68 |
| 3,238,947 | 3/1966 | Churnick | 129/16.8 |
| 3,245,162 | 4/1966 | McElroy | 40/23 |
| 3,245,859 | 4/1966 | Busk | 156/479 |
| 3,425,145 | 2/1969 | Newton | 40/23 |
| 3,444,635 | 5/1969 | Setzler | 40/2 |
| 3,552,640 | 1/1971 | Young | 229/68 |
| 3,580,815 | 4/1986 | Barber | 283/81 |
| 3,586,160 | 6/1971 | Heimann | 206/56 AB |
| 3,691,662 | 9/1972 | Cunningham | 40/23 A |
| 3,747,242 | 7/1973 | Heimann | 40/2 R |
| 3,779,393 | 12/1973 | Grundell | 211/126 |
| 3,780,460 | 12/1973 | Hurt | 40/78 |
| 3,801,408 | 4/1974 | Kuring et al. | 156/552 |
| 3,805,426 | 4/1974 | Cunningham | 40/2 R |
| 3,891,070 | 6/1975 | Montanari | 190/41 R |
| 3,933,294 | 1/1976 | Meenan et al. | 229/1.5 R |
| 3,937,493 | 2/1976 | Fasbender | 283/41 |
| 3,978,191 | 8/1976 | Allen et al. | 264/185 |
| 4,031,646 | 6/1977 | de Nouel | 40/359 |
| 4,050,719 | 9/1977 | Cunningham | 283/36 |
| 4,053,057 | 10/1977 | Snowden | 211/126 |
| 4,109,850 | 8/1978 | Meenan et al. | 229/72 |
| 4,175,476 | 11/1979 | Kidd | 93/1 E |
| 4,204,639 | 5/1980 | Barber et al. | 235/462 |
| 4,240,848 | 12/1980 | Barber | 158/64 |
| 4,274,577 | 6/1981 | Walsh | 229/1.5 R |
| 4,284,227 | 8/1981 | Corey | 229/1.5 R |
| 4,329,191 | 5/1982 | Barber | 156/64 |
| 4,400,107 | 8/1983 | Pitts | 402/4 |
| 4,486,261 | 12/1984 | Koller et al. | 156/461 |
| 4,523,776 | 6/1985 | Barber | 283/39 |
| 4,588,463 | 5/1986 | Barber et al. | 156/68 |
| 4,730,727 | 3/1988 | Petroff | 206/311 |
| 4,749,121 | 6/1988 | Barber | 229/1.5 R |
| 4,806,397 | 2/1989 | Horwitz | 229/1.5 R X |
| 4,830,268 | 5/1989 | Pitts | 229/68 R |
| 4,867,319 | 9/1989 | Arner et al. | 211/46 |
| 4,959,728 | 9/1990 | Effendi | 206/44 B |
| 4,966,639 | 10/1990 | Pfeffer et al. | 156/359 |
| 4,971,361 | 11/1990 | Whiting | 281/2 |
| 5,025,979 | 6/1991 | Dellacroce | 229/1.5 R |

FOREIGN PATENT DOCUMENTS

| | | | |
|---|---|---|---|
| 0001167 | 3/1979 | European Pat. Off. . | |
| 891985 | 10/1953 | Fed. Rep. of Germany . | |
| 1236472 | 3/1967 | Fed. Rep. of Germany . | |
| 3009430 | 9/1981 | Fed. Rep. of Germany . | |
| 3047230 | 7/1982 | Fed. Rep. of Germany . | |
| 1463195 | 11/1966 | France . | |
| 2278500 | 2/1976 | France . | |
| 2300685 | 9/1976 | France . | |
| 2477504 | 9/1981 | France . | |
| 2623749 | 6/1989 | France . | |
| WO90/03890 | 4/1990 | PCT Int'l Appl. . | |
| 141053 | 9/1930 | Switzerland . | |
| 926225 | 1/1935 | United Kingdom | 229/72 |
| 1123130 | 8/1968 | United Kingdom . | |

REINFORCED PAPER OFFICE SUPPLIES AND METHOD OF MAKING THEM

CROSS-REFERENCES TO RELATED APPLICATIONS

This application is a continuation-in-part of application Ser. No. 769,001 filed Sep. 30, 1991, still pending which is a continuation of application Ser. No. 483,094 filed Feb. 21, 1990, now U.S. Pat. No. 5,066,045.

BACKGROUND OF THE INVENTION

1. Field of the Invention

The present invention relates to various paper office supplies and, in particular, to those paper office supplies having reinforcement layers disposed along surfaces that are susceptible to premature wear and tear to make the office supplies stronger and more durable.

2. Description of the Prior Art

Paper office supplies are widely used by businesses and students to store, maintain and present documents. These supplies, herein generally referred to as folders, include hanging jackets or files, folders, shelf files, file jackets, report covers, portfolios, folder dividers, and binders. As widespread and popular as these folders are, however, they each suffer from the problem of premature wear and tear along certain critical areas. These areas include fold creases, areas that are frequently handled by office workers, areas that rub against other items such as file cabinets, and areas which are frequently subjected to pulling forces, such as the pockets in a folder.

These durability problems were surprising because extensive material tests are conducted in laboratories on characteristics such as tear strength, burst strength, and fold endurance of folders. It was estimated that in a normal to heavy use environment, the useful life of folders would be from 7 to 15 years.

In investigating this problem, it was found that there are several different factors that contribute to this premature wear and tear. A first factor is that skin oils and acids from the fingers of office workers are transferred to the folders while they are being handled. These oils and acids, coupled with constant abrasion from touching, weakens the paper in the folder and makes it susceptible to failing.

A second factor is that the folders are often overstuffed, thereby subjecting the folder to excessive weight and stress. This excessive weight and stress concentrates on the fold corners and points of intersection of different surfaces of the folders, and will cause the folder to fail at these locations.

Finally, the folders are often mishandled by the office workers who either drop them into file cabinets or onto work surfaces. This further weakens the folder at stress points such as corners and seams and will cause the folder to eventually burst or split.

This problem of premature wear and tear was not previously brought to the attention of those skilled in the art, because such folders are frequently discarded immediately after the premature failure is discovered.

A number of possible solutions are available and were contemplated to eliminate this problem. These solutions include using thicker weight paper or paper reinforcements in the folder, impregnating the paper with plastic, or making the folder entirely out of plastic. However, each of these solutions were rejected because of manufacturing and cost constraints.

Accordingly, there remains a need for a folder of superior strength that is durable, may be manufactured inexpensively, and that is not susceptible to premature wear and tear.

SUMMARY OF THE INVENTION

In accordance with the present invention there is provided a method for manufacturing improved paper office supplies which comprises determining which critical areas or portions of the office supplies are prone to wear and tear, and applying reinforcement upon or adjacent to those critical areas or portions to increase the strength and resistance of the office supplies to such wear and tear. This invention also provides specific examples of reinforced paper office supplies.

DETAILED DESCRIPTION OF THE PREFERRED EMBODIMENTS

Figure 1:
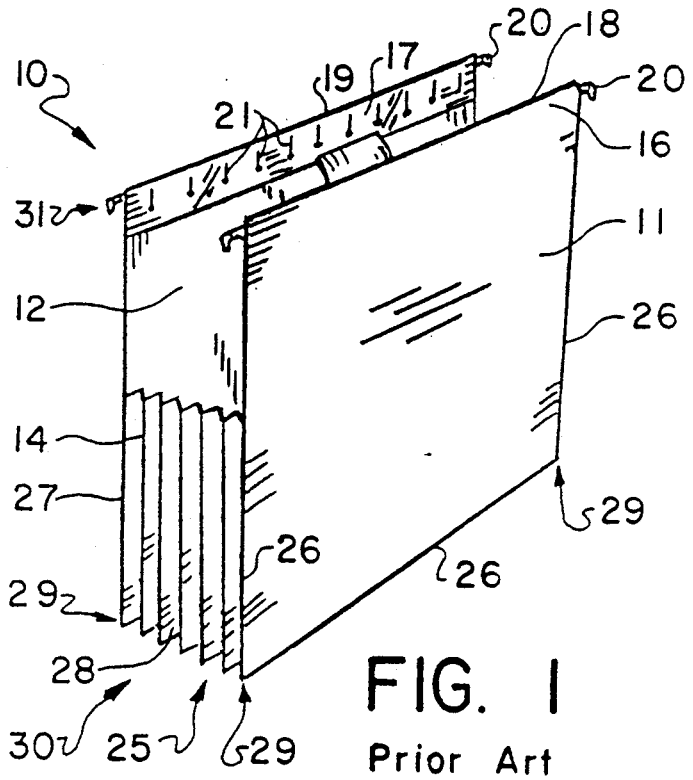
FIG. 1 Prior Art
FIG. 1 is a perspective view of a hanging box file.

In accordance with the present invention there is provided a paper office supply product such as a hanging file jacket or box file, a folder, a reinforced top folder, a file jacket, a slash pocket folder, a portfolio, a folder divider, or a binder, hereinafter referred to as an improved folder, that is stronger and more durable than existing folders. The improved folder is obtained by first identifying the critical areas of existing folders that are subject to premature wear and tear. These areas are commonly the more frequently touched, rubbed or stressed areas such as the edges, pockets, corners, fold creases, seams, and points of intersection of different surfaces of existing folders.

A layer of reinforcement is then applied to the improved folder along these critical areas while or immediately after the improved folder is manufactured and before the improved folder is used. This reinforcement comprises a strip of material that is applied along the critical areas on the surface of the improved folder, and is preferably a laminated plastic strip.

Due to the increased costs associated with plastic lamination, even though this increase is comparatively small, one skilled in the art would not have been inclined to apply a laminated strip to solve the problem of premature wear and tear. However, after conducting a cost-benefit analysis of various alternatives to solve this problem, the present inventors have discovered that plastic lamination provides the best solution to the problem of premature wear and tear.

A laminated strip improves by a factor of 10 the fold endurance and abrasion strength of the improved folders. This superior endurance results from the strength of the lamination which maintains the integrity of the folder even after the fibers in the paper have completely broken down and the strength of the paper has been compromised. Further, the added rigidity supplied by the laminated strip at least doubles the tear resistance of the folder.

The laminated strip provides other unexpected benefits to the improved folder. Since the paper used to make the folder is usually printed, (i.e. colored), slight wear will reveal the white color of the substrate beneath the colored paper. This will cause the folder to have an unsightly appearance and can cause problems if a color-coding filing system is employed. The laminated strip eliminates this problem by providing, in effect, a shield over the paper to prevent its wear.

The improved folders are also easier to work with, because the lower coefficient of friction created by the laminate makes sliding of the improved folder along a file cabinet easier. Thus, retrieving and filing the improved folder is faster and easier.

Applying the laminated strip to the improved folder can be accomplished with existing equipment, thereby avoiding a substantial financial investment in re-tooling. Further, the laminated strip only increases the cost of the improved folder by approximately 10% because thinner weight paper can be used in the folder. Thus, the benefits obtainable with the present invention may be achieved at a comparatively low cost.

The method described above for making office supplies stronger and more durable will now be discussed in relation to specific types of folders. For example, a hanging box file 10 is shown in FIG. 1. File 10 comprises a front panel member 11 and a rear panel member 12 that are connected to each other by connection means 14. If desired, connection means 14 may comprise a gusset to provide for expansion of file 10. The top ends of front and rear panel members 11, 12 are folded over onto themselves to form terminal folded portions 16, 17, respectively, with top edges 18, 19, respectively. Terminal folds 16, 17 provide an annular channel through which hanging rods 20 may be inserted. Terminal folds 16, 17 further comprise a plurality of slots 21 into which file tabs (not shown) may be inserted.

The critical areas of file 10 are along bottom 25, along the intersection 26, 27 of front and rear panel members 11, 12, respectively, with gusset 14, along lower side folds 28 of gusset 14, and at the lower corners 29 of file 10. These critical areas are hereinafter referred to as lower critical areas 30.

In addition, terminal folds 16, 17 and top edges 18, 19, hereinafter referred to as upper critical areas 31, are also subject to premature wear and tear.

Lower critical areas 30 tend to wear and tear prematurely because when file 10 is filled, critical areas 30 tend to drag along the bottom and sides of a file drawer. Further, office workers tend to either drop heavy objects into file 10 or overstuff and then drop file 10 into a filing drawer. This action tends to impose a great deal of stress on lower critical areas 30, which have already been weakened considerably due to the dragging along the bottom and sides of the file drawer.

Dropping items into and overstuffing file 10 also causes upper critical areas 31 to wear and tear prematurely because rods 20 cut into the paper that makes up these areas. Further, skin oils and acids, and constant abrasion from fingers touching file 10 causes upper critical areas 31 to wear away, thereby revealing the white color of the substrate and making file 10 prone to tearing.

Inserting and removing tabs into and from slots 21 further subjects terminal folds 16, 17 to premature wear due to the abrasion between the tabs and the edges of slots 21. In addition, office workers use the tabs as handles for moving file 10 in the file draw, further exasperating the wear problems of terminal folds 16, 17.

Figure 2:
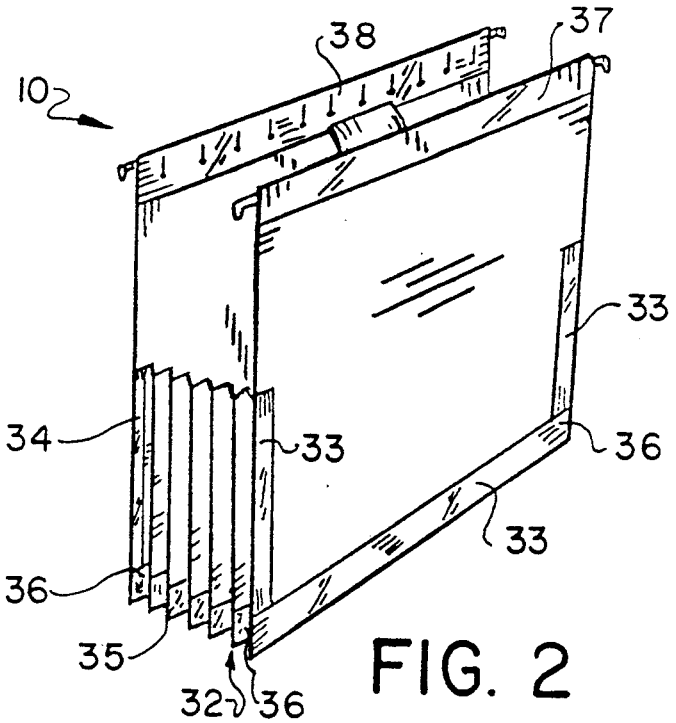
FIG. 2 is a perspective view of a hanging box file that is reinforced in accordance with the present invention.

As shown in FIG. 2, to make hanging box file 10 stronger and more durable, reinforcement layers 32, 33, 34, 35, and 36 are applied along bottom 25, intersections 26, 27, side folds 28, and lower corners 29, respectively. Reinforcement layers 32, 33, 34, 35 and 36 comprise plastic strips that are laminated to their respective critical areas. Preferably, reinforcement layers 32, 33, 34, 35 and 36 comprise a single piece of plastic that is secured to and trimmed in accordance with the contour of file 10. Reinforcement layers 32, 33, 34, 35 and 36 will provide additional strength and resistance to tearing to file 10, and will also substitute for lower critical areas 30 after their integrity and strength have been compromised.

Likewise, reinforcement layers 37, 38 are applied to terminal folds 16, 17 and top edges 18, 19 respectively, to increase the useful life of file 10. Preferably, layers 37, 38 comprise laminated plastic strips that completely cover terminal folds 16, 17, except for slots 21.

Besides increasing the strength and resistance to tearing of file 10, layers 37, 38 provide an unexpected advantage in that they cause folds 16, 17 to bow outwardly. This bowing causes slots 21 to pucker and makes it easier to insert the tabs therein, thereby eliminating the abuse to which terminal folds 16, 17 were formerly subjected.

Additionally, there is a tendency with hanging box files 10 for terminal folds 16, 17 and top edges 18, 19 to flex. This flexing, which causes hanging rods 20 to fall off guide rails (not shown), is generally resisted by rods 20. However, making rods 20 thick enough to resist this flexing is expensive, and the rods will be relatively heavy. However, since reinforcement layers 37, 38 increase the stiffness at the upper surfaces of file 10, the thickness necessary for rods 20 to resist this flexing is reduced. This is another unexpected benefit of the present invention.

Figure 3:
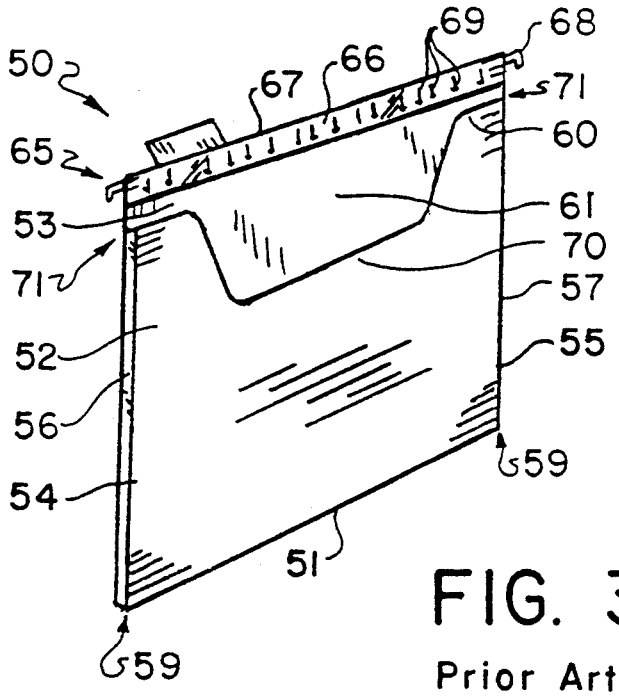
FIG. 3 Prior Art
FIG. 3 is a perspective view of a hanging file jacket.

An additional example of an application of the present invention is shown in FIG. 3, which illustrates a hanging file jacket 50. Jacket 50 comprises a sheet of paper that is folded at a medial line to form an edge 51, and front and rear panel members 52, 53 joined at edge 51. A remote edge 60 of front panel member 52 defines a cut-out region 61 with a lip 70 that allows easy access to the interior of jacket 50, and top portion or edge 65 of rear panel member 53 is folded over onto itself to form a terminal folded portion 66 with a top edge 67. Terminal fold 66 provides a channel through which hanging rod 68 is inserted. Terminal fold 66 further comprises a plurality of slots 69 into which file tabs (not shown) may be inserted. Jacket 50 further comprises lower corners 59 and upper corners 71. Sides 54, 55 of jacket 50 are connected by side members 56, 57, respectively, to prevent documents, etc. that are stored in jacket 50 from falling out of jacket 50.

The critical areas of jacket 50 are along edge 51, at lower corners 59, at terminal fold 66 and top edge 67 for the same reasons as discussed above with respect to hanging box file 10.

In addition, lip 70 and top corners 71 are critical areas due to the handling of jacket 50 by office workers. When jacket 50 is used, the office worker will generally grasp lip 70 and pull front panel member 52 away from rear panel member 53 to enlarge the opening of jacket 50, thereby making it easier to either insert documents into or remove documents from jacket 50. Over time, this repeated action will leave oils and acids from the workers fingers on jacket 50 at lip 70, and these oils and acids will soil and break down the fibers in the paper. Thus, jacket 50 will have an unattractive appearance and will be susceptible to tearing. The pulling of front panel member 52 away from rear panel member 53 also exerts large tensile forces on upper corners 71, thereby causing jacket 50 to tear at these locations.

Figure 4:
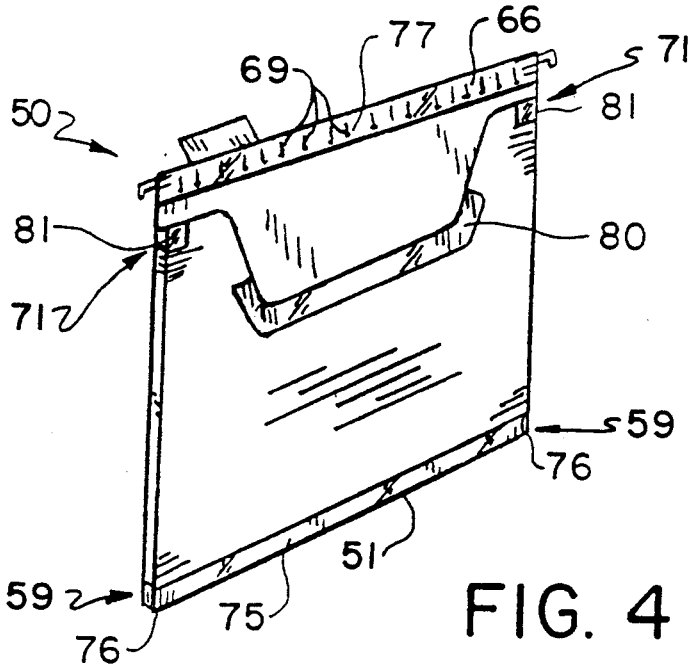
FIG. 4 is a perspective view of a hanging file jacket that is reinforced in accordance with the present invention.

As shown in FIG. 4, to make jacket 50 stronger and more durable, reinforcement layers 75, 76, and 77 are applied along edge 51, at lower corners 59, and along terminal fold 66, except for slots 69, respectively, to achieve the same benefits and advantages as discussed above for hanging box file 10. Preferably, reinforcement layers 75, 76, and 77 comprise plastic strips that are laminated to the surface of jacket 50. If desired, reinforcement layers 75 and 76 may comprise a single strip of plastic that is secured to and trimmed in accordance with the contour of file 10.

Further, a layer of reinforcement 80 is applied along lip 70, on both the inner and outer surfaces of front panel member 52, to increase the wear resonance and prolong the useful life of jacket 50. Layer 80 acts as a barrier to prevent oils and acids from being deposited on front panel 52, and it also greatly increases the tear resistance of jacket 50. Preferably, layer 80 comprises a sheet of plastic laminated to front panel 52.

Finally, reinforcement layers 81 are attached to upper corners 71. Layers 81 extend around side members 56, 57 and are attached to the outer surfaces of front and rear panel members 52 and 53. Reinforcement layers 81 prevent the separation of front and rear panel members 52, 53 when they are pulled apart and greatly increase the useful life of jacket 80.

Figure 5:
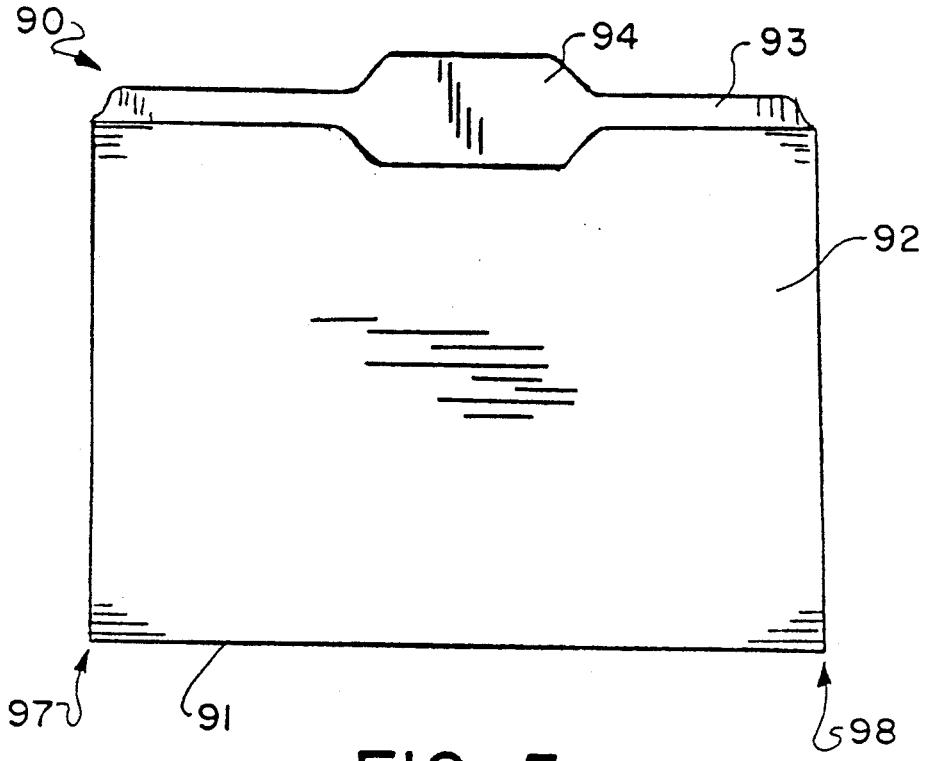
FIG. 5 Prior Art
FIG. 5 is a front elevational view of a manila, kraft, reinforced top, or colored file folder.
Figure 6:
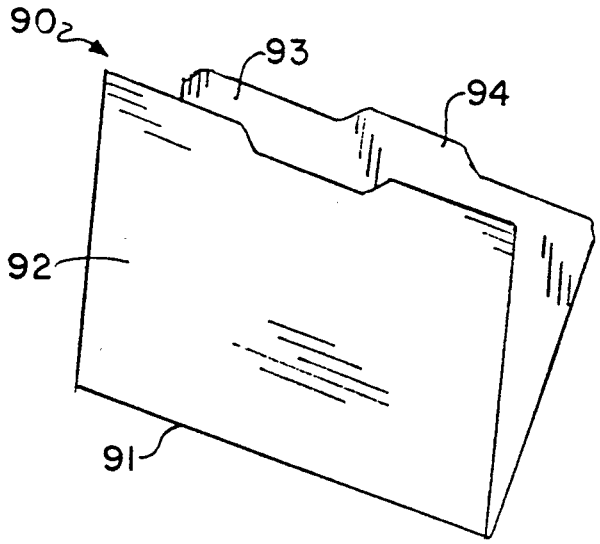
FIG. 6 Prior Art
FIG. 6 is a perspective view of a manila, kraft, reinforced top, or colored file folder.

A manila, kraft, reinforced top, or colored file folder 90 is shown in FIGS. 5 and 6. This folder generally comprises a sheet of paper that is folded at a medial line to form an edge 91, and front and rear panels 92, 93 that are joined at edge 91. Folder 90 also generally comprises a tab 94 affixed to rear panel 93 for identifying the contents of folder 90.

Folder 90 tends to prematurely wear along edge 91 because of the constant flexing edge 91 experiences when folder 90 is opened and closed. Further, folder 90 is typically stored vertically on a shelf, with edge 91 abutting the shelf. Thus, when folder 90 is stored on or removed from the shelf, it is generally slid along edge 91. This sliding causes edge 91 to quickly wear away and fray.

Folder 90 is also often overstuffed, thereby causing front and rear panels 92, 93 to be stretched in an attempt to completely cover the documents. This stretching causes a tension along fold edge 91, particularly at corners 97, 98, and will eventually cause edge 91 to tear.

A second critical area of folder 90 is at tab 94 because of the constant handling tab 94 experiences. When an office worker is searching for a particular document, he goes through a plurality of folders by leafing through and reading the tabs. This constant, repeated contact causes the tabs to become soiled, creased and frayed and creates an undesirable appearance in the filing system. Thus, these folders often will be discarded merely because tab 94 has become unattractive.

Figure 7:
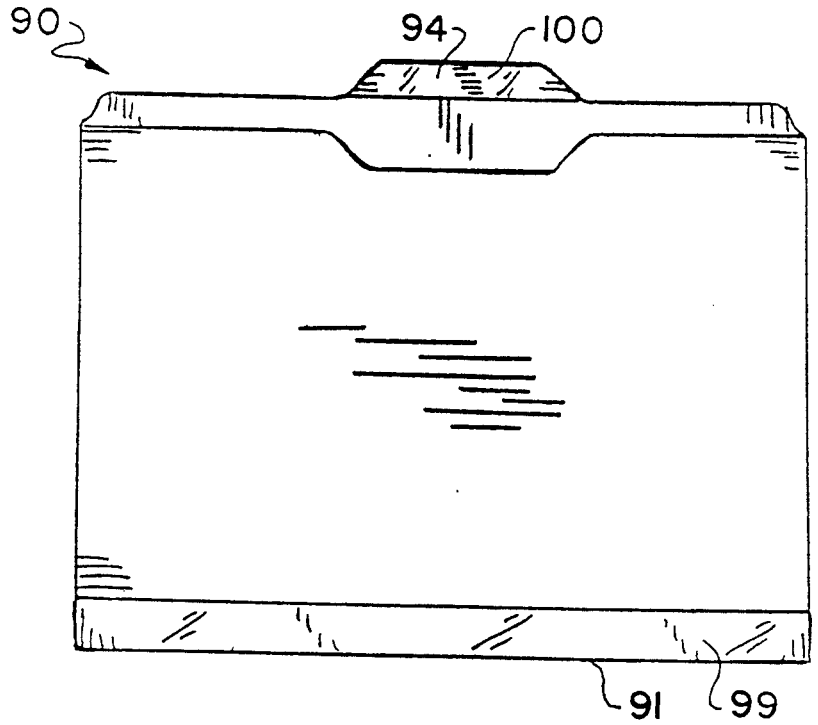
FIG. 7 is a front elevational view of a manila, kraft, reinforced top, or colored file folder that is reinforced in accordance with the present invention.
Figure 8:
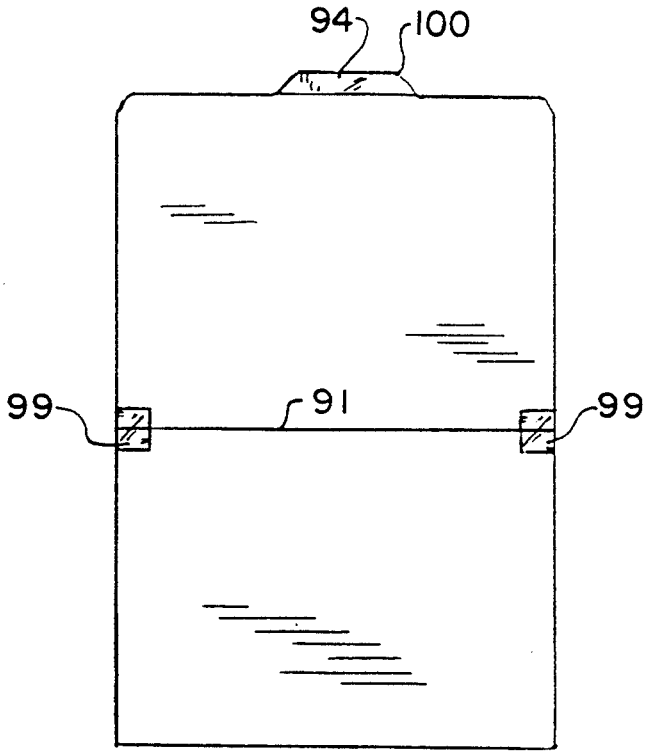
FIG. 8 is a plan view of the interior of a manila, kraft, reinforced top, or colored file folder that is reinforced in accordance with the present invention.

As shown in FIGS. 7 and 8, to increase the strength and prolong the life of folder 90, reinforcement layers 99, 100 are applied along edge 91 and tab 94, respectively. Preferably, reinforcement layers 99, 100 are strips of plastic that are laminated to the surface of folder 90. Reinforcement layer 99 completely covers edge 91 and extends onto the adjacent lower surfaces of front and rear panel members 92, 93. Further, reinforcement layer 99 wraps around the edge of folder 90 and extends onto the inner surface of edge 91 to completely cover and maintain the integrity of corners 97, 98.

Reinforcement layer 100 is attached to both sides of tab 94 and acts as a barrier to finger oil and acids, thereby preventing tab 94 from becoming soiled or frayed. Further, layer 100 increases the rigidity of tab 94 to prevent it from becoming torn or creased. Accordingly, layers 99, 100 increase the strength, life, and resistance to tearing of folder 90.

Figure 9:
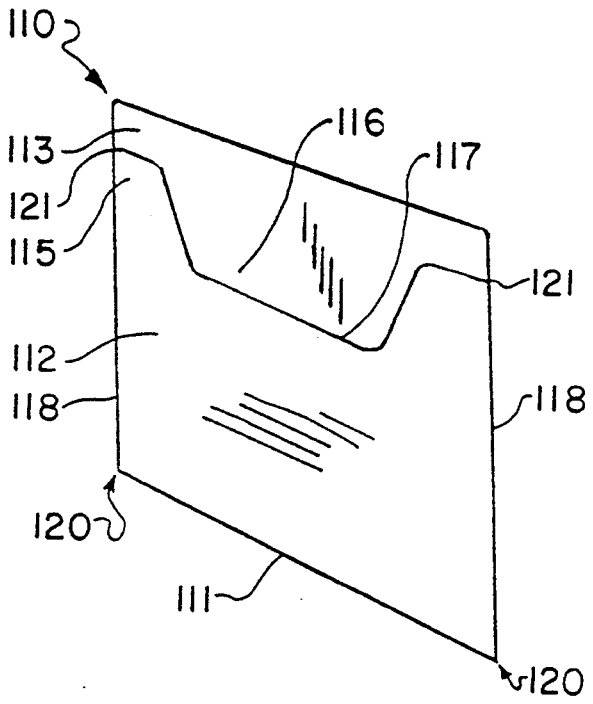
FIG. 9 Prior Art
FIG. 9 is a perspective view of a file jacket.

An additional example of the present invention is shown in FIG. 9, which shows a file jacket 110. Jacket 110 is similar to hanging file jacket 50, discussed hereinabove in detail. Jacket 110 comprises a sheet of paper that is folded at a medial line to form an edge 111, and front and rear panel members 112, 113 joined at edge 111. Remote edge 115 of front panel 112 defines a cutout region 116 with a lip 117 that allows easy access to the contents of jacket 110, and the side edges of front and rear panels 112, 113 are secured to each other with a suitable adhesive such as glue to form pocket edges 118. Pocket edges 118 prevent documents stored in jacket 110 from slipping out of jacket 110. Jacket 110 further comprises lower corners 120 and upper corners 121.

The critical areas of jacket 110 are along edge 111 and at lower corners 120 due to the constant abrasion of these areas against storage shelves and work surfaces. Further, when in use, jacket 110 is usually overstuffed, which causes jacket 110 to rip or tear along edge 111 and at lower corners 120. The overstuffing also causes tension along pocket edges 118 and will eventually cause jacket 110 to burst therealong.

In addition, lip 117 and upper corners 121 are critical areas because, when jacket 110 is used, the office worker will generally grasp lip 117 and pull front panel member 112 away from rear panel member 113 to enlarge the opening of jacket 110. Over time, this action will leave oils and acids from the workers fingers on jacket 110 that will soil and break down the fibers in the paper. Thus, jacket 110 will have an unattractive appearance and will be susceptible to tearing. The pulling action also exerts large tensile forces on upper corners 121 and will cause jacket 110 to tear at these locations.

Figure 10:
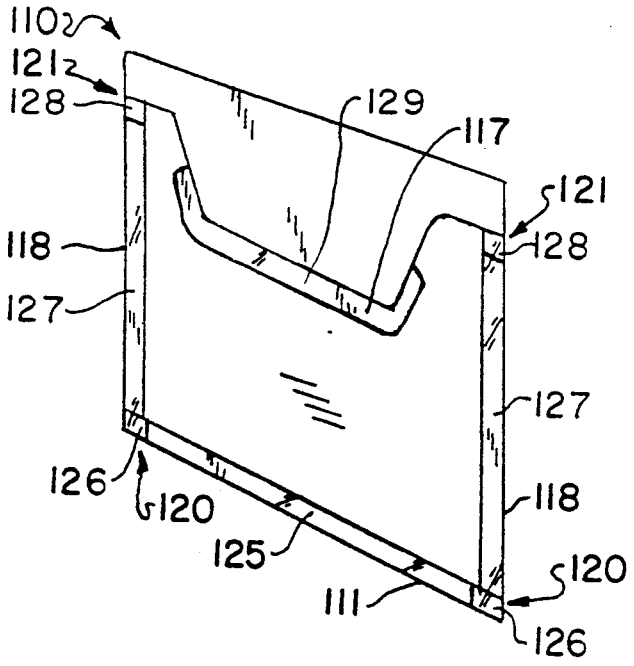
FIG. 10 is a perspective view of a file jacket that is reinforced in accordance with the present invention.

As shown in FIG. 10, to make jacket 110 stronger and more durable and to increase its useful life, reinforcement layers 125, 126, 127, 128 and 129 are applied along edge 111, at lower corners 120, along pocket edges 118, at upper corners 121 and along lip 117, respectively. Preferably, the reinforcement layers comprise plastic strips that are laminated onto the surface of jacket 110.

Layer 125 is applied along edge 111 and extends onto the adjacent lower surfaces of front and rear panel members 112, 113. Layer 125 acts as a shield to prevent wear and fraying of edge 111 and will prevent edge 111 from tearing. Further, layer 125 will substitute for edge 111 after its integrity and strength have been compromised.

Reinforcement layers 126 are applied to corners 120 on the outer surfaces of front and rear panels 112, 113. Layers 126 also act as a shield to prevent wearing and fraying of corners 120, and also increase their rigidity to prevent them from being creased or crushed when jacket 110 is dropped onto a table or desk top. If desired, layers 125 and 126 could be a single piece of plastic strip that is attached to and trimmed in accordance with the contour of jacket 110.

Reinforcement layers 127 are applied along edge 118 and extend onto the adjacent surfaces of front and rear panels 112, 113. Layers 127 will prevent pocket edges 118 from splitting should jacket 110 be overstuffed, and they prevent wear of edge 118 due to rubbing of folder 10 against work surfaces.

Reinforcement layers 128 are applied to upper corners 121 and extend from front panel 112, over edge 118, and onto rear panel 113. Layers 128 will prevent upper corners 121 from tearing when front panel 112 is pulled away from rear panel 113. If desired, layers 127 and 128 could also be made from a single piece of plastic strip that is appropriately attached and trimmed.

Layer 129 is preferably attached to the inner and outer surfaces of front panel member 112 along lip 117 and acts as a barrier to prevent oils and acids from being deposited on front panel 112. Layer 129 also greatly increases the tear resistance of jacket 110 at lip 117. Preferably, reinforcement layer 129 comprises a single plastic strip that is laminated to jacket 110.

Accordingly, reinforcement layers 125, 126, 127, 128, and 129 increase the strength and resistance to tearing of jacket 110.

Figure 11:
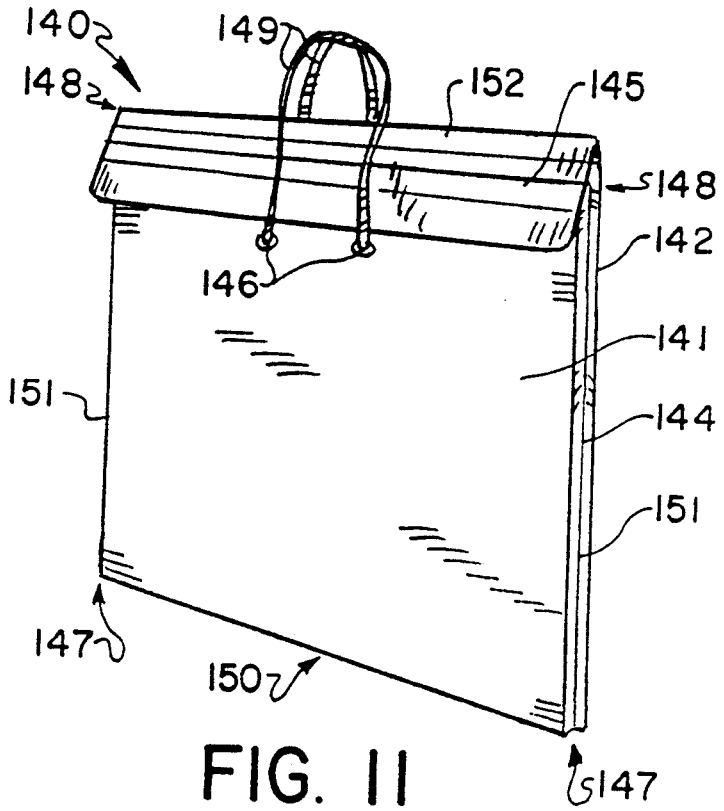
FIG. 11 Prior Art
FIG. 11 is a perspective view of an artist's portfolio.

FIG. 11 shows an artist's portfolio 140 which comprises a front panel member 141 and a rear panel member 142 that are connected to each other by connection means 144. Connection means 144 defines bottom 150 and sides 151 of portfolio 140, and, if desired, connection means 144 may comprise a gusset to provide for expansion of portfolio 140. Portfolio 140 also comprises a cover 145 which protects the contents of portfolio 140. Preferably, cover 145 is formed integrally with rear panel member 142 at a fold edge 152. Front and rear panel members 141, 142 comprise openings 146 through which handles 149 are inserted and secured. Portfolio 140 further comprises lower corners 147 and upper corners 148.

The critical areas of portfolio 140 are along bottom 150 and sides 151, at lower corners 147, and at upper corners 148 due to abrasion, overstuffing, and pulling as described above with respect to other types of paper office supplies. In addition, edge 152 is a critical area due to repeated opening and closing of cover 145 to gain access to the contents of portfolio 140. Further, the areas around openings 146 are critical areas because when portfolio 140 is carried by handles 149, the weight of portfolio 140 causes handles 149 to tear into front and rear panels 141, 142.

Figure 13:
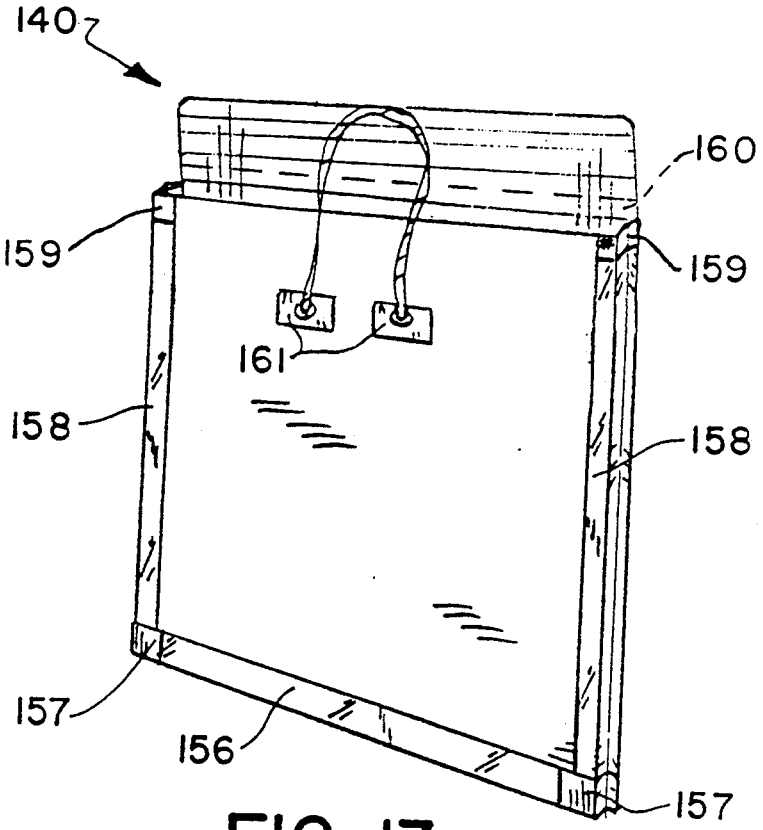
FIG. 13 is a perspective view of an artist's portfolio with the top open that is reinforced in accordance with the present invention.
Figure 12:
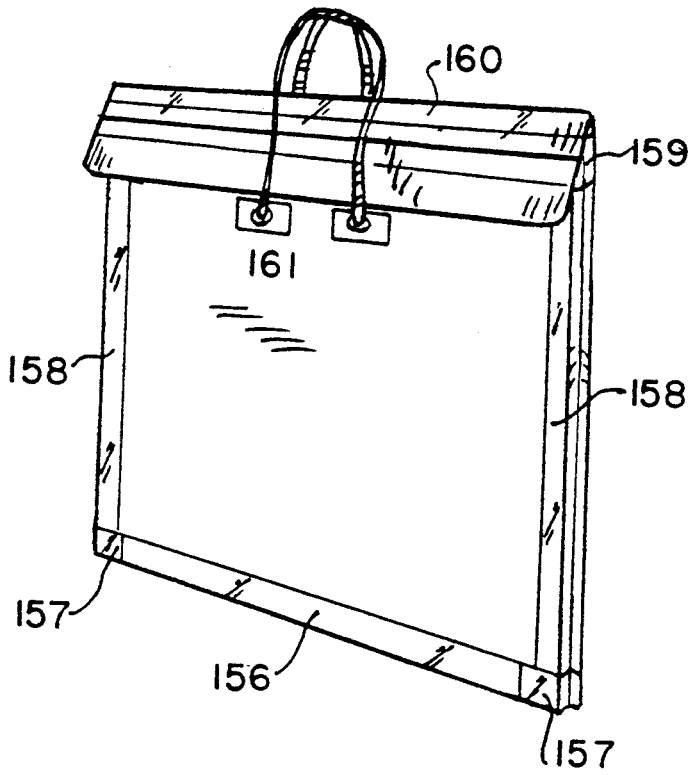
FIG. 12 is a perspective view of an artist's portfolio that is reinforced in accordance with the present invention.

As shown in FIGS. 12 and 13, to make artist's portfolio 140 stronger and more durable, reinforcement layers are applied to these critical areas. The reinforcement layers preferably comprise strips of plastic that are laminated to the surface of portfolio 140.

A first reinforcement layer 156 is applied along bottom 150 and extends onto the adjacent lower surfaces of front and rear panels 141, 142. Layer 156 acts as a shield to prevent wearing, fraying, and tearing of these areas of portfolio 140.

Similarly, a second reinforcement layer 157 is applied to lower corners 147 on the outer surfaces of front and rear panels 141, 142. Layers 157 act as a shield to prevent wearing and fraying of corners 147, and also increase their rigidity to prevent them from being creased or crushed when portfolio 140 is dropped onto a work surface or the floor. If desired, layers 156 and 157 could comprise a single plastic strip that is appropriately trimmed and laminated.

Similarly, third reinforcement layers 158 are applied along sides 151 and extend onto the adjacent surfaces of front panel 141 and rear panel 142. Layers 158 increase the strength, resistance to tearing and resistance to wear of portfolio 140. If desired, layers 156 and 159 could also be a single piece of plastic that is appropriately trimmed and laminated.

Fourth reinforcement layers 159 are applied to upper corners 148 and extend from front panel 141, over side 151, and onto rear panel 142. Layers 159 prevent upper corners 149 from tearing when front panel 141 is pulled away from rear panel 142. If desired, layers 158 and 159 could be made from a single piece of plastic strip that is appropriately attached and trimmed.

A fifth reinforcement layer 160 is applied along edge 152 and extends onto the adjacent sides of cover 145 and rear panel member 142. Layer 160 acts as a shield to prevent wear and fraying of edge 152 and will prevent cover 145 from tearing away from rear panel 143 along edge 152.

Sixth reinforcement layers 161 are applied to front and rear panel members 141, 142 around openings 146 to increase the strength of front and rear panels 141, 142 and prevent handles 149 from tearing into portfolio 140. Accordingly, after reinforcing layers 156, 157, 158, 159, 160 and 161 are secured to the critical areas of portfolio 140, the strength, resistance to tearing and fraying, and the life of portfolio 140 will be substantially increased.

Figure 14:
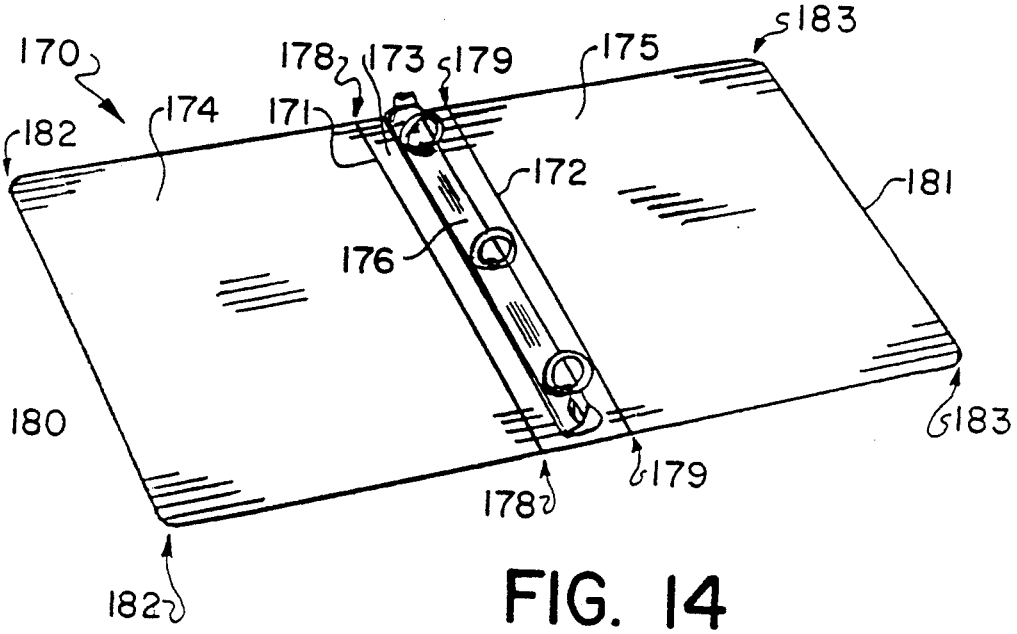
FIG. 14 Prior Art
FIG. 14 is a perspective view of the inside of a three-ring pressboard binder.
Figure 15:
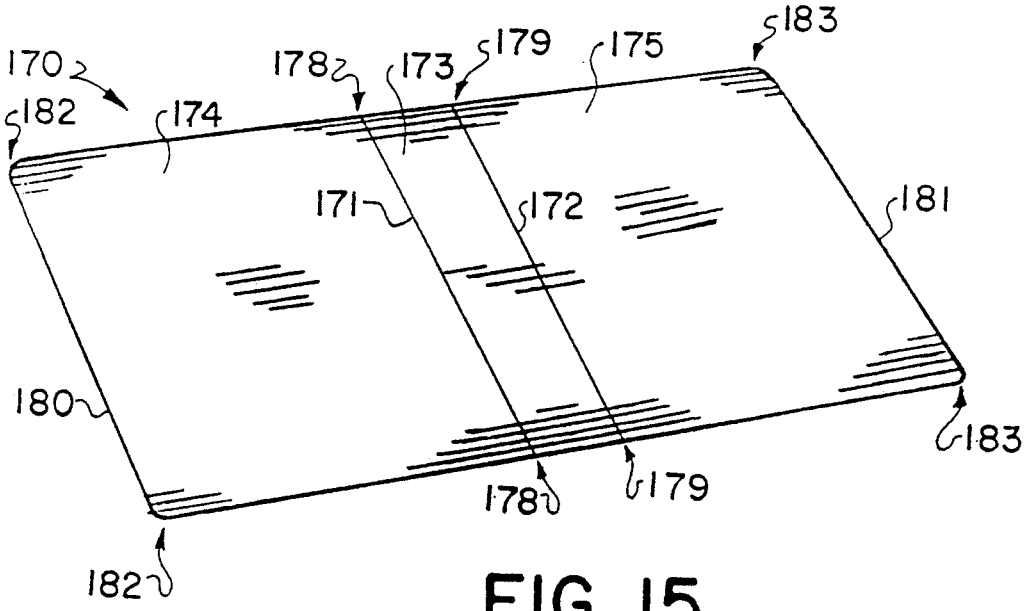
FIG. 15 Prior Art
FIG. 15 is a perspective view of the outside of a three-ring pressboard binder.

A three-ring pressboard binder 170 is shown in FIGS. 14 and 15. Binder 170 comprises a relatively rigid sheet of material having two score lines 171, 172 which define a spine portion 173, a front cover 174 having and edge 180 and a rear cover 175 having an edge 181. A ring assembly 176 is secured to spine 173 and is used to retain documents in binder 170. Front and rear covers 174, 175 are configured and dimensioned to be folded along score lines 171, 172, respectively, to protect the documents in binder 170. Binder 170 further comprises spine corners 178, 179 and cover corners 182, 183.

In use, front cover 174 is repeatedly opened and closed to gain access to the documents stored in binder 170. This repeated action weakens binder 170 along score line 171 and causes score line 171 to tear and fray. Further, when binder 170 is handled and transported from one location to another by an office worker, it is usually held at spine 173. Oils and acids from the hands of the office workers soil binder 170 and break down the fibers in the paper, thereby further weakening score line 171. Binder 170 may also be held at edges 180, 181 or dropped thereon while it is being transported, which will cause binder 170 to wear therealong for the same reasons discussed above.

Further, when binder 170 is placed upon a desk or tabletop, score line 172 usually rubs against the work surface. This rubbing, coupled with oils and acids from the workers hands, causes binder 170 to wear and fray along score line 172. Still further, binder 170 is usually dropped onto the work surface or otherwise roughly handled. This action causes corners 178, 179, 182 and 183 to wear away and fray very rapidly, and it also causes the corners to become crumpled, buckled and creased.

Figure 16:
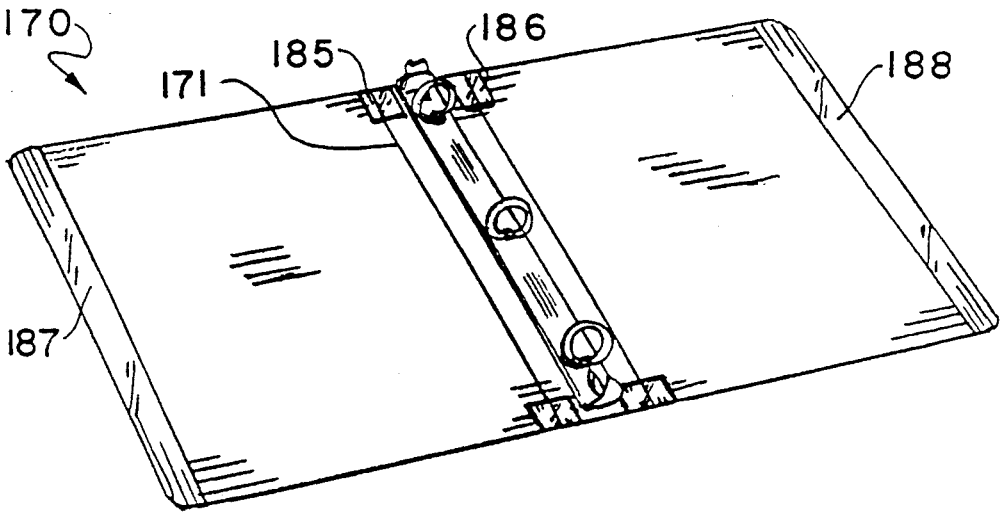
FIG. 16 is a perspective view of the inside of a three-ring pressboard binder that is reinforced in accordance with the present invention.
Figure 17:
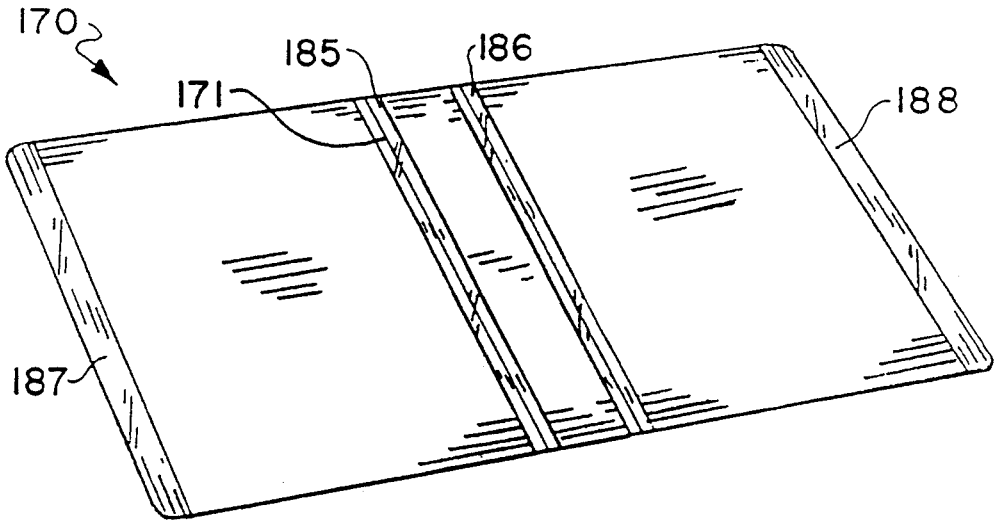
FIG. 17 is a perspective view of the outside of a three-ring pressboard binder that is reinforced in accordance with the present invention.

Each of the above-described actions contribute to rapid wear and a shortened useful life of three-ring pressboard binder 170. To counteract those detrimental effects, as shown in FIGS. 16 and 17, first, second, third and fourth reinforcement layers 185, 186, 187 and 188, respectively, are applied to binder 170. Preferably, reinforcement layers 185, 186, 187 and 188 comprise plastic strips that are laminated to the surface of binder 170.

A first reinforcement layer 185 is disposed along score line 171 and extends onto the adjacent surfaces of front cover 174 and spine 173. Further, layer 185 preferably wraps around the top and bottom edges of binder 170 and extends onto the inner surfaces of score line 171, front cover 174 and spine 173. Layer 185 therefore will act as a shield to protect binder 170 from finger oils and acids, and will prevent premature wear to score line 171 due to repeated openings and closing and abrasion of front cover 174. The extension of layer 185 onto the inner surfaces of score line 171 provides additional reinforcement to spine corners 178 and will protect corners 178 from wear and crimping.

Likewise, a second reinforcement layer 186 is disposed along score line 172 and extends onto the adjacent surfaces of rear cover 175 and spine 173. Further, layer 186 preferably wraps around the top and bottom edges of binder 170 and extends onto the inner surfaces of score line 172, rear cover 175 and spine 173. Thus, as discussed above with respect to layer 185, layer 186 will act as a shield to protect binder 170 from premature wear and tear, and will also protect spine corners 179 from wear and crimping.

A third reinforcement layer 187 is disposed along edge 180 and extends onto the adjacent inner and outer surfaces of front cover 174 a distance sufficient to also shield cover corners 182. Third layer 187 acts as a shield to prevent premature wear, tear, and soiling of edge 180 and cover corners 182, and it also reinforces cover corners 182 to help prevent creasing or crumpling of corners 182.

Likewise, fourth reinforcing layer 188 is disposed along edge 181 and edge corner 183 on both the inner and outer surfaces thereof to achieve the same results obtained with reinforcing layer 187.

Accordingly, reinforcing layers 185, 186, 187, and 188 increase the strength and resistance to tearing and soiling of three ring pressboard binder 170.

Figure 18:
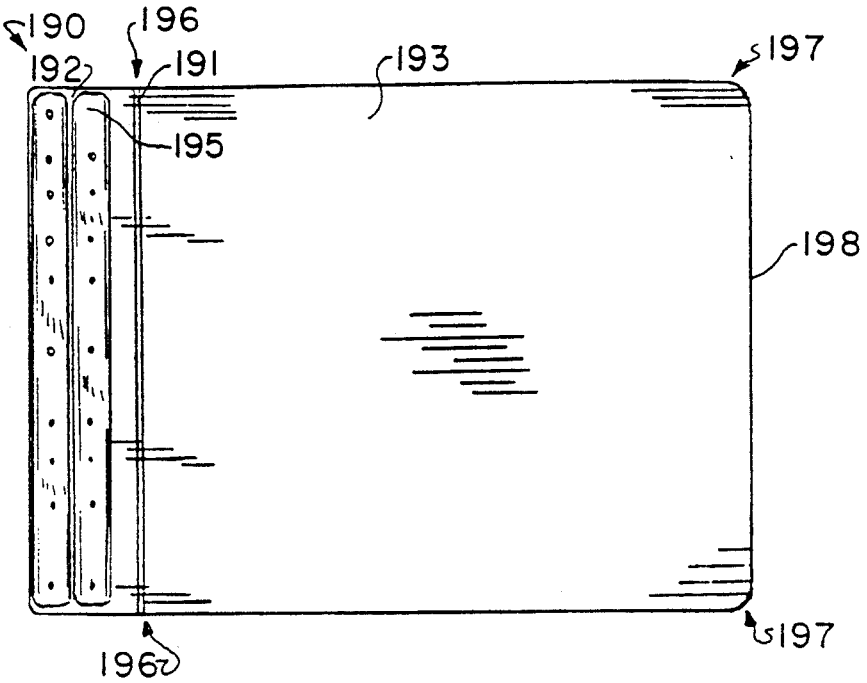
FIG. 18 Prior Art
FIG. 18 is a plan view of the interior surface of a pressboard data binder.
Figure 19:
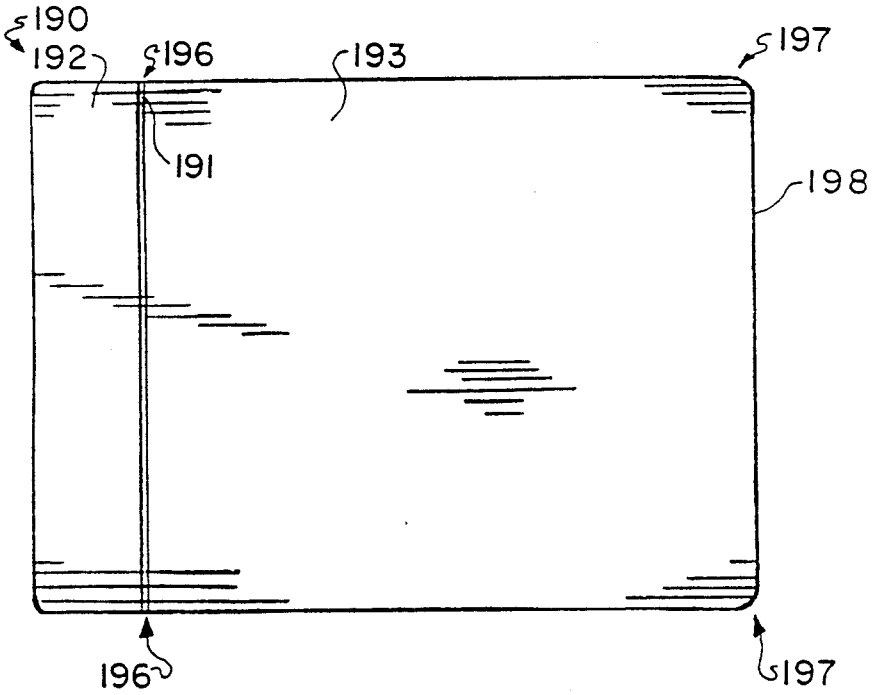
FIG. 19 Prior Art
FIG. 19 is a plan view of the exterior surface of a pressboard data binder.

A pressboard data binder 190 is shown in FIGS. 18 and 19. Data binder 190 comprises a relatively rigid sheet of material having a score line 191 that defines a spine portion 192 and a backboard portion 193 with an edge 198. Backboard portion 193 is configured and dimensioned to support a stack of documents, such as a computer printout, for viewing. A holding mechanism 195 is secured to spine 192 and is used to maintain the stack of documents on backboard 193. Binder 190 further comprises backboard corners 196 and edge corners 197.

The critical areas of data binder 190 are substantially the same as the critical areas of three-ring pressboard binder 170 for substantially the same reasons discussed above. These critical areas include score line 191, backboard corners 196, edge 198 and edge corners 197.

Figure 20:
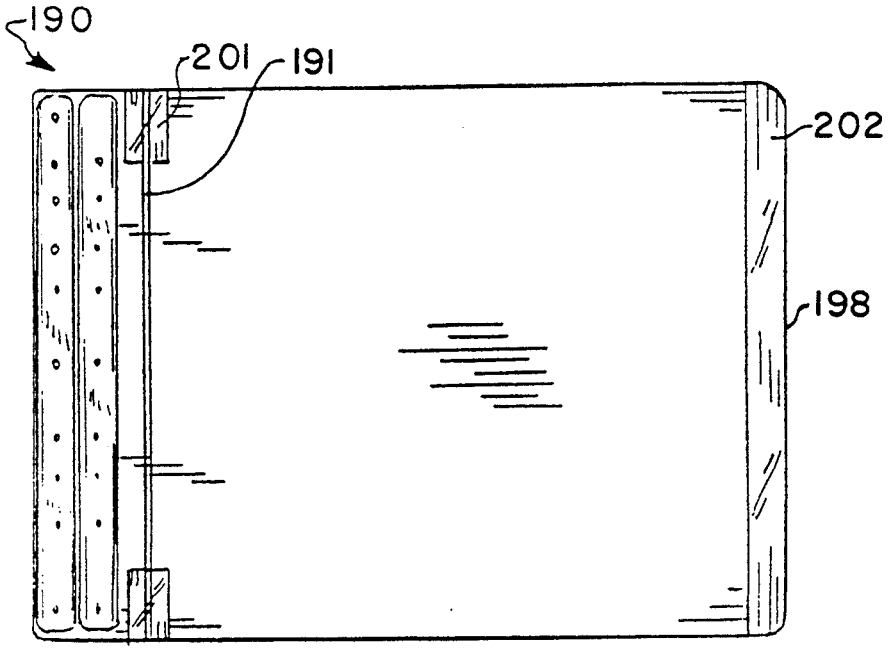
FIG. 20 is a plan view of the interior surface of a pressboard data binder that is reinforced in accordance with the present invention.
Figure 21:
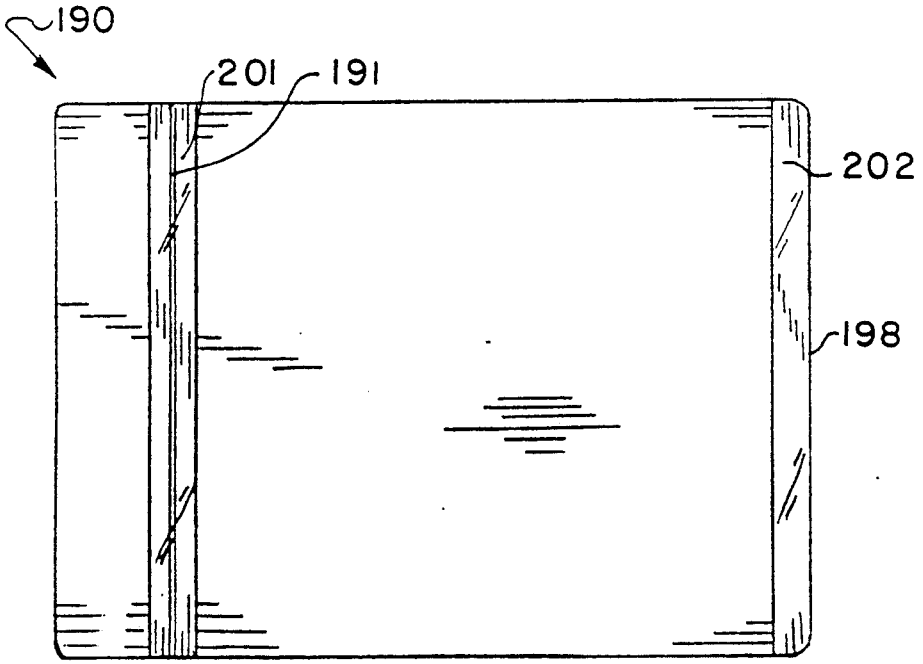
FIG. 21 is a plan view of the exterior surface of a pressboard data binder that is reinforced in accordance with the present invention.

Accordingly, as shown in FIGS. 20 and 21, to increase the durability, strength, and resistance to wear and tear of data binder 190, first and second reinforcement layers 201, 202, respectively, are applied along score line 191 and edge 198, respectively. Reinforcement layers 201, 202 preferably comprise plastic strips that are laminated to the surface of binder 190.

First reinforcement layer 201 is disposed along score line 191 and extends onto the adjacent surfaces of spine 192 and backboard 193. Further, layer 201 preferably wraps around the side edges of binder 190 and extends onto the top surfaces of score line 192, spine 192 and backboard 193. Layer 201 therefore acts as a shield to protect binder 190 from finger oils and acids, and will prevent premature wear and tear to score line 192 due to repeated flexing and contact with work surfaces. The extension of layer 201 onto the inner surfaces of score line 191 provides additional reinforcement to backboard corners 196 and will protect them from wear and crimping.

Second reinforcement layer 202 is disposed along edge 198 and extends onto the adjacent inner and outer surfaces of backboard 193 a distance sufficient to also shield cover corners 197. Second layer 202 acts as a shield to prevent premature wear, tear and soiling of edge 198 and edge corners 197, and it also reinforces edge corners 197 to help prevent them from creasing and crumpling.

Figure 22:
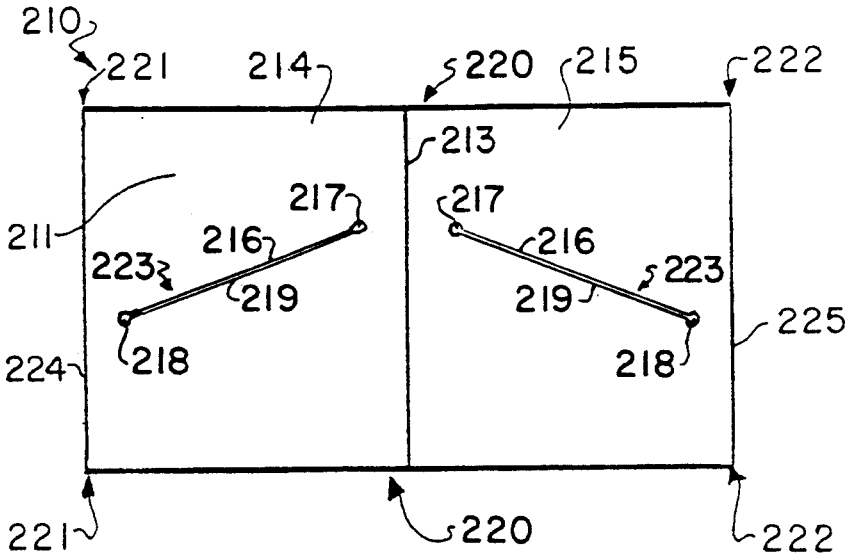
FIG. 22 Prior Art
FIG. 22 is a plan view of the interior of a slash pocket folder.
Figure 23:
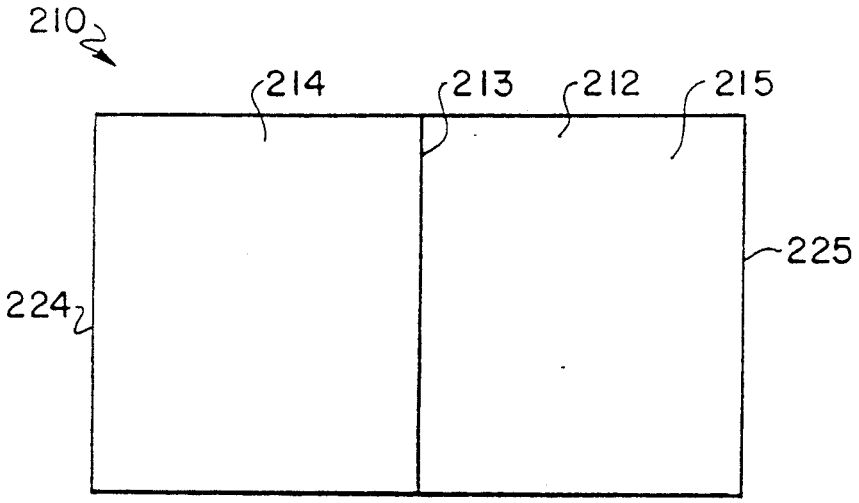
FIG. 23 Prior Art
FIG. 23 is a plan view of the exterior of a slash pocket folder.

A slash pocket folder 210 is shown in FIGS. 22 and 23. Folder 210 comprises an inner 211 and an outer 212 sheet of flexible material that are secured to each other about their peripheral edges. Inner and outer sheets 211, 212 have a score line 213 which defines a front cover 214 and a rear cover 215. Front and rear covers 214, 215 have edges 224, 225, respectively, and are configured and dimensioned to be folded along score line 213 to form folder 210. Inner sheet 211 of front cover 214 includes a slash 216 with ends 217, 218 and a lip 219 which forms a pocket 223 for storing documents. This slash may be at any angle with respect to the spine of the folder, including horizontal, vertical, or any angle therebetween. Also, if desired, inner sheet 211 of rear cover 215 may comprise a similar pocket. However, only pocket 223 will be discussed herein. Folder 210 further comprises score corners 220, front cover corners 221 and rear cover corners 222.

Folder 210 is subject to premature wear and tear along similar critical areas as discussed above with respect to other types of paper office supplies. Specifically, folder 210 wears along the outer surface of score line 213 due to contact with and abrasion against other objects and work surfaces, and due to contact with finger oils and acids. Further, score line 215 is prone to burst due to overstuffing of folder 210. Finally, corners 220, 221, and 222 are subject to wear, crumpling and creasing from being dropped on work surfaces.

In addition, ends 217, 218 of slash 216 are especially prone to tearing when folder 210 is used. When documents are to be stored in pocket 223, lip 219 is grasped and pulled away from front cover 214 to enlarge the opening of pocket 223. This action creates a large tensile force at ends 217, 218 and causes ends 217, 218 to tear.

Also, each time lip 219 is grasped and pulled, finger oils and acids are deposited on the paper. These oils and acids soil and breakdown the fibers in the paper. Thus, an undesirable appearance is created, and pocket 223 is more susceptible to tearing.

Figure 24:
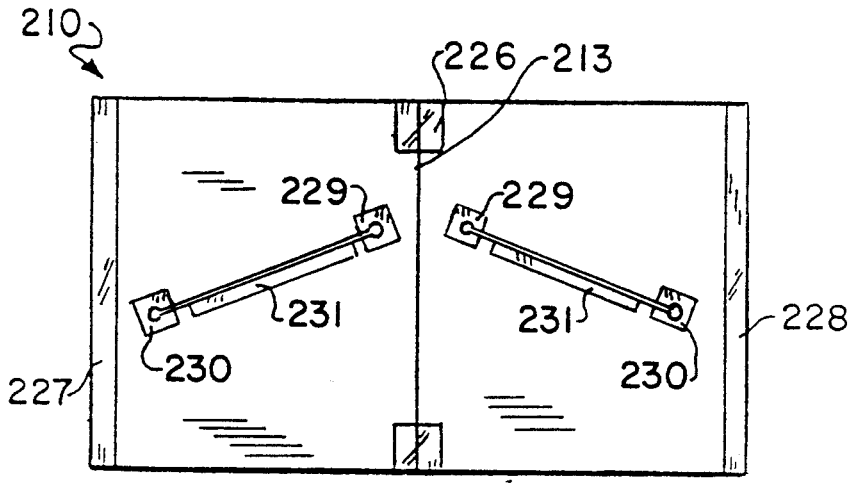
FIG. 24 is a plan view of the interior of a slash pocket folder that is reinforced in accordance with the present invention.
Figure 25:
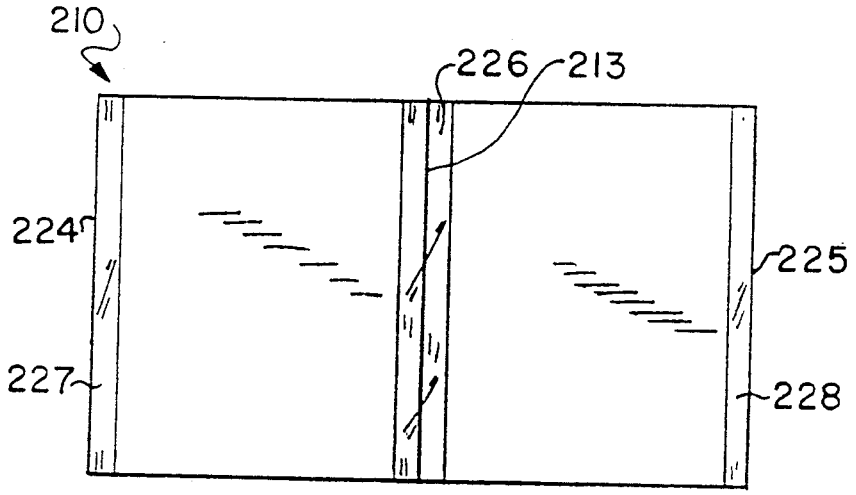
FIG. 25 is a plan view of the exterior of a slash pocket folder that is reinforced in accordance with the present invention.

Referring now to FIGS. 24 and 25, to increase the strength and durability of folder 210, appropriate reinforcing layers are applied thereto. A first reinforcement layer 226 is disposed along the outer surface of score line 213 and extends onto the adjacent surfaces of front and rear covers 214, 215. Further, layer 226 preferably wraps around the top and bottom edges of folder 210 and extends onto the top surfaces of score line 213 and front and rear covers 214, 215. Layer 226 acts as a shield to prevent the permeation of finger oils and acids into folder 210, and increases the resistance to tearing of score line 226. The extension of layer 226 onto the inner surfaces of score line 213 provides additional reinforcement to score corners 220 and will protect them from wear and crimping.

A second reinforcement layer 227 is applied along edge 224 and extends onto the adjacent inner and outer surfaces of front cover 214 a distance sufficient to shield front cover corners 221. Second layer 227 acts as a shield to prevent premature wear, tear and soiling of edge 224 and corners 221, and it also reinforces corners 221 to help prevent their creasing and crumpling.

Similarly, a third reinforcement layer 228 is applied along edge 225 and rear cover corners 222 to obtain the same benefits and advantages described above with respect to second layer 227.

Fourth and fifth reinforcement layers 229, 230 are applied to ends 217, 218, respectively, of pocket 223. Layers 229, 230 will provide additional strength and rigidity to edges 217, 218 and will prevent them from prematurely tearing when lip 219 is grasped and pulled away from front cover 214.

A sixth reinforcement layer 231 is applied to both the inner and outer surfaces of lip 219. Layer 231 acts as a barrier to finger oils and acids to keep folder 210 clean, and it bolsters the strength of lip 219 to prevent it from tearing.

Accordingly, reinforcement layers 226, 227, 228, 229, 230, and 231 increase the strength, resistance to tearing and soiling, and life of slash pocket folder 210.

Figure 26:
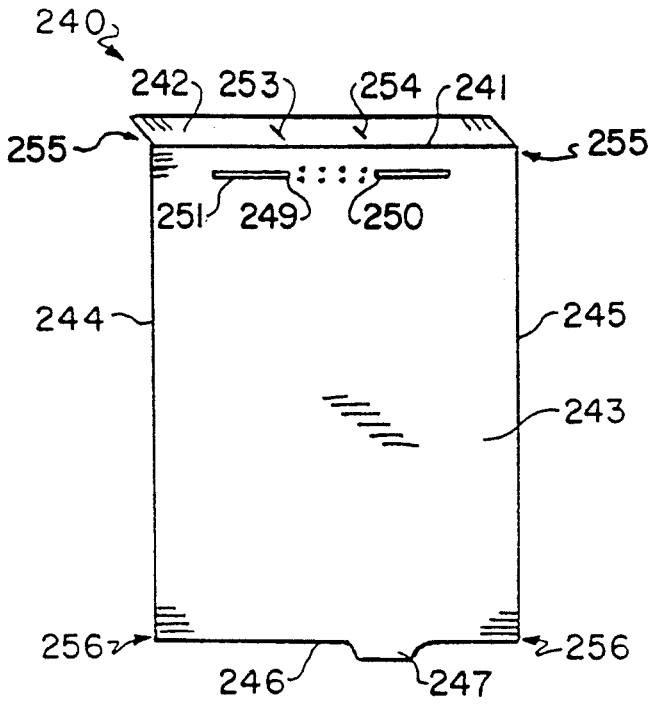
FIG. 26 Prior Art
FIG. 26 is a plan view of one side of a folder divider.
Figure 27:
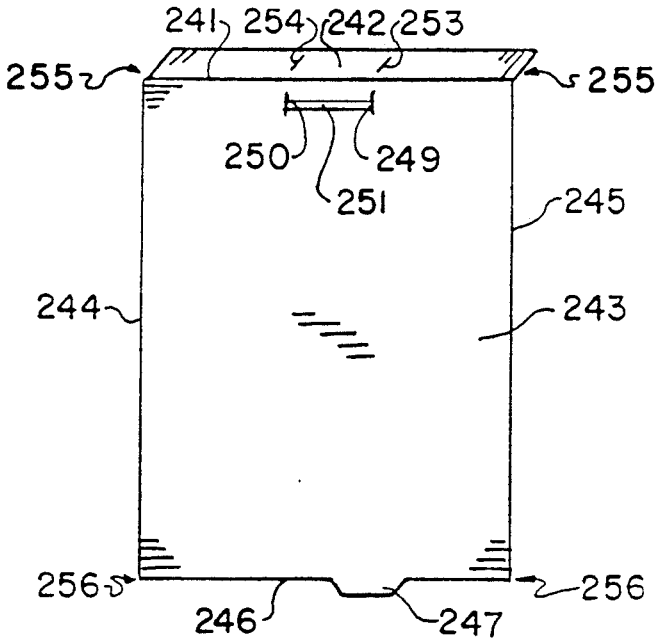
FIG. 27 Prior Art
FIG. 27 is a plan view of the opposite side of a folder divider.

A folder divider 240 is shown in FIGS. 26 and 27. Divider 240 comprises a relatively stiff sheet of material having a score line 241 that defines a flap 242 and a backboard portion 243. Background portion 243 has two side edges 244, 245 and a remote edge 246. Formed integrally with background portion 243 at edge 246 is a tab member 247. Backboard portion 243 further comprises at least two apertures 249, 250 through which a paper securing member 251 passes. Flap 242 also comprises at least two apertures 253, 254 adapted to receive securing member 251. Divider 240 further comprises flap corners 255 and remote corners 256.

Figure 28:
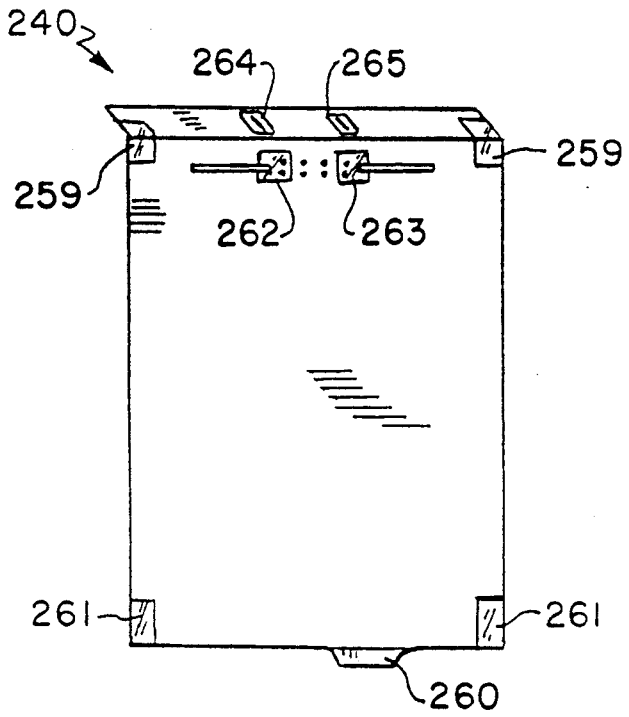
FIG. 28 is a plan view of one side of a folder divider that is reinforced in accordance with the present invention.
Figure 29:
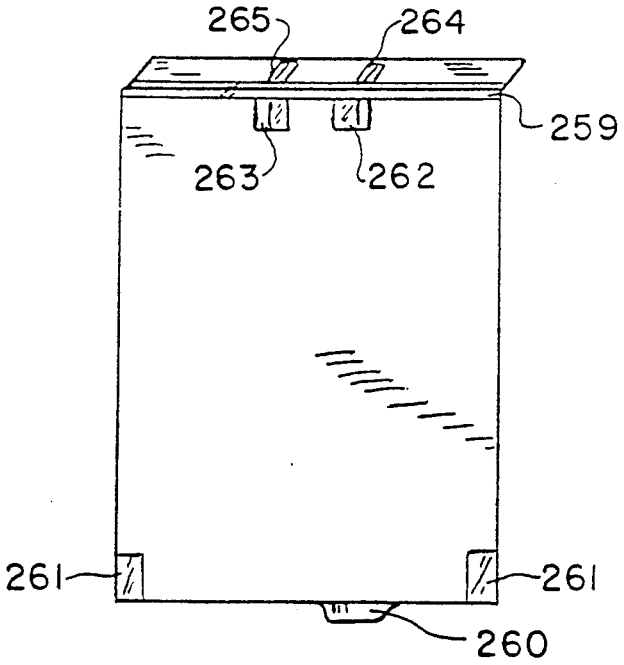
FIG. 29 is a plan view of the opposite side of a folder divider that is reinforced in accordance with the present invention.

The critical areas of divider 240 are along score line 241, at flap corners 255, at remote corners 256, and at tab member 247 for similar reasons as discussed above for other types of paper office supplies, Accordingly, as shown in FIGS. 28 and 29, to increase the strength, resistance to tearing, fraying, creasing, and crumpling of divider 240, reinforcing layers are applied thereto. A first reinforcement layer 259 is disposed along score line 241 on the outside of divider 240 and extends onto the adjacent surfaces of flap 242 and backboard 243. Further, layer 259 preferably wraps around edges 244, 245 onto the inner surfaces of score line 241, flap 242 and backboard 243. Layer 259 will therefore act as a shield to protect divider 240 from premature wear and tear along score line 241, and will also protect flap corners 255 from wear and crimping.

A second reinforcement layer 260 us applied to both sides of tab member 247. Layer 260 will shield and reinforce tab member 247 and will therefore provide it with greater rigidity to make it resistant to folding, crumpling, and fraying.

Third reinforcement layers 261 are applied to remote corners 256. Layers 261 will increase the strength, resistance to tearing and fraying, and the resistance to crumpling of corners 256.

Fourth reinforcement layers 262, 263 are applied around apertures 249, 250, respectively, on backboard portion 243. Preferably, reinforcement layers 262, 263 are applied to both the inner and outer surfaces of backboard 243. However, if desired, layers 262, 263 may be applied to only the inner or outer surfaces thereof. Layers 262, 263 increase the strength of backboard 243 around apertures 249, 250 to resist tearing and fraying due to contact with securing member 251.

Finally, fifth reinforcement layers 264, 265 are applied around apertures 253, 254, respectively, on flap 242 to achieve the same results described above with layers 262, 263.

Figure 30:
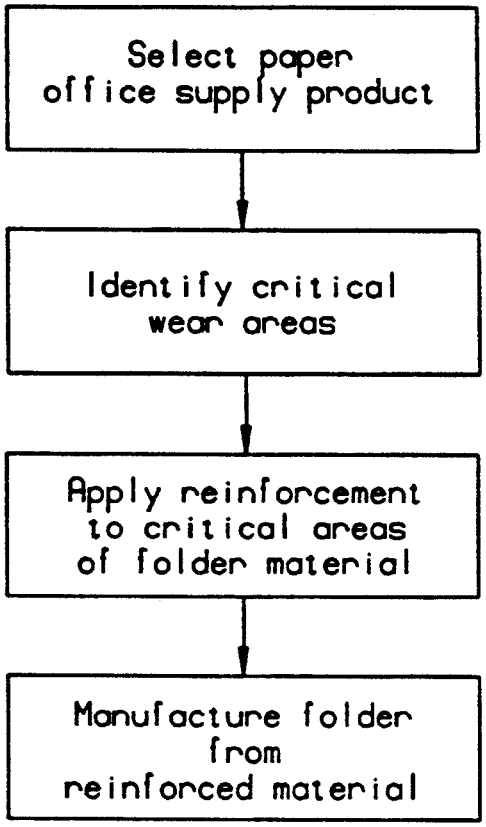
FIG. 30 is a schematic block diagram of a preferred method for making the folders of the invention.

Accordingly, reinforcement layers 259, 260, 261, 262, 263, 264, and 265 increase the strength, rigidity, and resistance to wear, tear, and soiling of divider 240. One method of making the folders of the invention is shown schematically in FIG. 30. First, the paper office supply product to be manufactured is selected, and the critical areas are identified. Next, it is preferred to apply the reinforcements to the material which is used to form the folder prior to manufacturing thereof. The folder is then made from the material which includes the reinforcements using conventional equipment. If desired, it is possible to apply the reinforcements to the folder after it is made, rather than to apply such reinforcements to the material which is used to manufacture the folder.

In accordance with the provisions of the patent statues, we have explained the principle of our invention and have illustrated and described what we now consider to represent some of its best embodiments. However, it should be understood that within the scope of the appended claims, the invention may be practiced otherwise than as specifically illustrated and described.

What is claimed is:

1. A method for manufacturing paper office supply folders having extended useful service lives, which comprises:

determining at least two critical areas of the folder which are prone to wear and tear; and applying separate plastic reinforcements upon or adjacent to at least two of the critical areas of the folder to form laminates therewith for increasing the strength and resistance of the folder to such wear and tear, wherein at least one reinforcement extends substantially completely across the full length or width of the folder.

2. The method of claim 1, wherein one critical area comprises a fold crease in the folder, and which further comprises applying one plastic reinforcement substantially along the fold crease.

3. The method of claim 1, wherein the paper office supply folder includes two or more edges which constitute the critical areas, and which further comprises applying the reinforcements to at least two of the edges.

4. The method of claim 1, wherein the paper office supply folder includes a pocket with edges which constitute one of the critical areas, and which further comprises applying one of the plastic reinforcements along at least one of the pocket edges.

5. The method of claim 1, wherein the paper office supply folder includes a pocket with a lip which constitutes one critical area, and which further comprises applying one of the plastic reinforcements along the pocket lip.

6. The method of claim 1, wherein one critical area comprises portions of the paper office supply folder which surround one or more holes therein, and which further comprises applying one of the reinforcements adjacent the perimeter of at least one hole.

7. The method of claim 1, wherein the critical areas comprise portions of the paper office supply folder which surround a plurality of holes in the paper office supply, and which further comprises applying the reinforcement adjacent the perimeter of each hole.

8. The method of claim 1, wherein one critical area comprises a bottom portion of the paper office supply folder, and which further comprises applying one of the plastic reinforcements along the bottom portion.

9. The method of claim 1, wherein one critical area comprises a side portion of the paper office supply folder, and further comprises applying one of the plastic reinforcements along the side portion.

10. The method of claim 1, wherein one critical area comprises a region of the paper office supply folder that is subject to frequent abrasion or touching, and which further comprises applying one of the plastic reinforcements upon substantially all of such region.

11. The method of claim 1, wherein one critical area comprises a corner of the paper office supply folder, and which further comprises applying one of the plastic reinforcements along the corner.

12. The method of claim 1, wherein one critical area comprises a seam in the paper office supply folder, and which further comprises applying one of the plastic reinforcements substantially completely along the seam.

13. The method of claim 1, wherein one critical area comprises a portion where a first surface of the paper office supply folder is joined to a second surface of the paper office supply folder, and which further comprises applying one of the plastic reinforcements along the joined portions and onto the first and second surfaces.

14. The method of claim 1 which further comprises selecting the folder to be a hanging jacket, hanging file, hanging folder, a shelf file, a file jacket, a report cover, a portfolio, a divider folder or a binder.

15. The method of claim 1 which further comprises applying the plastic reinforcements as separated strips upon different areas of the folder.

16. The method of claim 15 wherein one of the separate strips of plastic reinforcement is applied over a portion of the other.

17. The method of claim 15 which further comprises applying plastic reinforcements to a plurality of different critical areas of the folder.

18. A method for manufacturing reinforced hanging box file folders having extended useful service lives, which comprises:

determining at least two critical areas of the folder which are prone to wear and tear; and applying separate plastic reinforcements upon or adjacent to at least two critical areas of the folder to form laminates therewith for increasing the strength and resistance of the folder to wear and tear;

wherein the folder includes a front panel member and a rear panel member attached to each other by connection means, the front and rear panel members each having top ends that are folded over onto themselves to form terminal folded portions, with the connection means defining the bottom and sides of the hanging box file; and wherein a first reinforcement in the form of a continuous strip of plastic material substantially completely covers the sides and bottom of the connection means and is laminated thereto.

19. The method of claim 18, which further comprises applying a second reinforcement in the form of a strip of plastic material upon and covering the terminal folded portion of at least one of the front and rear panel members.

20. The method of claim 18, which further comprises providing uniformly spaced slots on the inner surface of the terminal folded portions for receiving label tabs, wherein the color of the exterior of at least the terminal fold is a different color than the interior surface of the front and rear panel members, at least in the area of the terminal folded portions, such that the visible part of the material forming the slots contrasts in color with the material visible through the slots.

21. The method of claim 20, which further comprises applying a third reinforcement in the form of a strip of material upon and covering the terminal folded portions of the folder, excluding the slots.

22. The method of claim 18, wherein the connection means and the front and rear panel members define lower corners, and which further comprises applying a fourth reinforcement upon and covering the lower corners.

23. The method of claim 18, wherein the first reinforcement is applied to also cover portions of the front and rear panel members that are adjacent to the bottom and sides.

24. A method for manufacturing reinforced hanging file jacket folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a sheet of flexible material folded at a medial line to form an edge, and front and rear panel members joined at the edge, the rear panel member having a top end that is folded over onto itself to form a top terminal folded portion; and connection means for attaching the side edges of the front and rear panel members, with the connection means defining the sides of the hanging file jacket;

wherein a first reinforcement in the form of a strip of plastic material is disposed substantially completely along the edge of the hanging file jacket.

25. The method of claim 24, wherein the first plastic reinforcement is applied to cover both the medial line and portions of the front and panel members adjacent the edge.

26. The method of claim 24, which further comprises applying a second reinforcement in the form of a strip of material which covers the terminal folded portion.

27. The method of claim 24, wherein the front and rear panel members define lower corners, and which further comprises applying a third reinforcement over the lower corners.

28. The method of claim 24, which further comprises providing means for hanging the folder on a standard filing frame in office storage equipment.

29. The method of claim 28, wherein the hanging means comprises a rod having notches complementary to the standard filing frame, the rods being disposed through the terminal folded portions.

30. The method of claim 29, which further comprises applying a second plastic reinforcement in the form of a strip of material disposed along the terminal folded portions.

31. The method of claim 30 wherein the second plastic reinforcement is applied to also cover the upper edge of the rear panel member.

32. The method of claim 29, which further comprises providing uniformly spaced slots on the inner surface of the terminal folded portion for receiving label tabs, wherein the color of the exterior of at least the terminal fold is a different color than the interior surface of the rear panel member, at least in the area of the terminal folded portion, such that the visible part of the material forming the slots contrasts in color with the material visible through the slots.

33. The method of claim 32, which further comprises applying a second reinforcement on the terminal folded portion and the top areas of the rear panel member, excluding the slots.

34. The method of claim 33, which further comprises selecting the folder to be made of one of colored paper, plastic and fiber, and the rods to be made of metal.

35. The method of claim 24, wherein a remote edge of the front panel member had a cut-out region that defines a lip with an edge, and which further comprises applying a fourth reinforcement in the form of a strip of material which covers the edge.

36. The method of claim 35, wherein the fourth reinforcement is a plastic film which is applied to extend onto the interior and exterior surfaces of the front panel member.

37. The method of claim 24, wherein the front panel member comprises upper corners, and which further comprises applying a fifth reinforcement on the upper corners and extending onto a corresponding surface on the rear panel member.

38. A method for manufacturing reinforced manila, kraft, reinforced top or colored file folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a sheet of flexible material folded at a medial line to form a fold edge, and front and rear sides joined at the fold edge; and a tab member affixed to one of the front or rear sides on an edge opposite the fold edge; and wherein a first reinforcement in the form of a strip of plastic material is disposed substantially completely along the fold edge.

39. The method of claim 38, wherein the first plastic reinforcement is applied to cover both the medial line and portions of the front and rear sides adjacent the fold edge.

40. The method of claim 38, wherein the front and rear sides comprise lower corners, and which further comprises applying the first reinforcement on the opposite side of the medial line to protect the lower corners.

41. The method of claim 40, wherein the first reinforcement is a single strip of plastic film which covers the lower corners, the medial line and the front and rear outer sides of the folder adjacent the fold edge.

42. The method of claim 38, which further comprises applying a second reinforcement in the form of a strip of plastic material upon the tab member.

43. The method of claim 42, wherein the second plastic reinforcement is applied to completely cover both sides of the tab member.

44. A method for manufacturing reinforced file jacket folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a sheet of flexible material folded at a medial line to form an edge, and front and rear panel members joined at the edge; and connection means for attaching the side edges of the front and rear panel members, with the connection means defining sides of the film jacket; and wherein a first reinforcement in the form of a strip of plastic material is disposed substantially completely along the edge of the file jacket and is laminated thereto.

45. The method of claim 44, wherein the first plastic reinforcement is applied to cover both the medial line and portions of the front and panel members adjacent the edge.

46. The method of claim 44, wherein the front and rear panel members comprise lower corners, and which further comprises applying a second plastic reinforcement in the form of a plastic strip or a laminated material which covers the lower corners.

47. The file jacket of claim 44, wherein the front and rear panel members include side edges and which further comprises applying a third reinforcement in the form of a plastic strip which covers the side edges.

48. The method of claim 44, wherein a remote edge of the front panel member has a cut-out region that defines a lip having an edge, and which further comprises applying a fourth reinforcement in the form of a strip of material which covers the edge of the lip.

49. The method of claim 48, wherein the fourth reinforcement extends onto the interior and exterior surfaces of the front panel member.

50. The method of claim 44, wherein the front panel member comprises upper corners, and which further comprises applying a fifth reinforcement on the upper corners and extending onto a corresponding surface on the rear panel member.

51. A method of manufacturing reinforced artist's portfolio folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a front panel member and a rear panel member attached to each other with connection means, the connection means defining a bottom and sides of the artist's portfolio; a cover connected to a top edge of the rear panel member; and a handle inserted through openings in the front and rear panel members;

wherein the first plastic reinforcement in the form of a continuous strip of plastic material is disposed substantially completely along the sides and bottom and is laminated thereto.

52. The method of claim 51, wherein the first plastic reinforcement is applied to cover the sides, bottom and portions of the front and rear panel members adjacent thereto.

53. The method of claim 51, wherein the connection means and the front and rear panel members define lower corners, and which further comprises applying a second plastic reinforcement upon the lower corners.

54. The method of claim 51, wherein the front panel member comprises upper corners, and which further comprises applying a third reinforcement to the upper corners and extending to corresponding portions on the rear panel member to prevent separation of the front and rear panel members from the connection means.

55. The method of claim 51, which further comprises applying a fourth reinforcement along the connection between the cover and the top edge of the rear panel member.

56. The method of claim 55, wherein the fourth plastic reinforcement is applied to cover both the connection and portions of the cover and rear panel member adjacent the connection.

57. The method of claim 51, wherein the front and rear panel members have portions which surround the openings therein, and which further comprises applying a fifth reinforcement to the portions surrounding the openings.

58. A method of manufacturing reinforced binder folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a sheet of material having first and second score lines, the first score line defining a front cover and a portion of a spine, the second score line defining a rear cover and the remainder of the spine, the front and rear covers being configured and dimensioned to be folded along their respective score lines to form a protective cover; and a ring assembly attached to the same;

wherein a first reinforcement in the form of a strip of plastic material is substantially completely disposed along the first score line; and a second plastic reinforcement in the form a of a strip of plastic material is substantially completely disposed along the second score line;

wherein the first and second plastic reinforcements are laminated to the sheet.

59. The method of claim 58, wherein each of the first and second plastic reinforcements covers both the first and second score lines, respectively, and portions of the front and rear covers adjacent their respective score lines.

60. The method of claim 58, wherein the front and rear covers each have corners adjacent the spine, and wherein each of the first and second plastic reinforcements extends over the spine corners and onto the opposite sides of the front and rear covers.

61. The method of claim 58, wherein the front and rear covers each includes edges opposite the first and second score lines, and which further comprises applying third and fourth reinforcements along the opposite edges.

62. The method of claim 61, wherein the front and rear covers have inner and outer surfaces and wherein the third and fourth reinforcements each comprises a plastic film which covers the opposite edges and adjacent inner and outer surfaces of the front and rear covers, respectively.

63. The method of claim 62, wherein the opposite edges each have corners and wherein the third and fourth plastic reinforcements are applied to also cover the corners.

64. A method of manufacturing reinforced data binder folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a rigid sheet of material having a score line that defines a spine portion and a backboard portion, the backboard portion being configured and dimensioned to support a stack of documents; and a holding mechanism secured to the spine portion;

wherein a first plastic reinforcement in the form of a strip of plastic material is substantially completely disposed along the score line.

65. The method of claim 64, wherein the first plastic reinforcement is applied to cover both the score line and the spine and backboard portions adjacent the score line.

66. The method of claim 65, wherein the data binder further comprises spine corners, and wherein the first plastic reinforcement is applied to extend over the spine corners.

67. The method of claim 65, wherein the backboard portion comprises an edge opposite the score line, and which further comprises applying a second reinforcement in the form of a strip of plastic material substantially completely along the opposite edge.

68. The method of claim 67, wherein the backboard portion has inner and outer surfaces, wherein the second plastic reinforcement is applied to cover the opposite edge and adjacent inner and outer surfaces of the backboard portion.

69. The method of claim 68, wherein the opposite edge has corners, and wherein the second plastic reinforcement is applied to cover the corners.

70. A method for manufacturing reinforced slash pocket folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes inner and outer sheets of flexible material secured to each other around their peripheral edges, the sheets having a score line which defines a front cover and a rear cover, the inner sheet of the front cover having a slash with ends defining a pocket and lip; and wherein a first plastic reinforcement in the form of a strip of plastic material is substantially completely disposed along the outer surface of the score line.

71. The method of claim 70, wherein the first plastic reinforcement covers the score line and portions of the front and rear covers adjacent the score line.

72. The method of claim 71, wherein the front and rear covers define a corner at the top and bottom of the score line, and wherein the first plastic reinforcement is applied to extend over the corners.

73. The method of claim 70, which further comprises applying a second plastic reinforcement on the inner sheet of the front cover adjacent the ends of the slash.

74. The method of claim 70, which further comprises applying a third reinforcement in the form of a strip of material along the lip of the pocket.

75. The method of claim 74, wherein the lip has inner and outer surfaces, and wherein the third reinforcement is a plastic film which covers the lip and the inner and outer surfaces of the folder adjacent the lip.

76. The method of claim 70, wherein the front and rear covers comprise edges opposite the score line, and which further comprises applying fourth and fifth reinforcements in the form of strips of plastic material along the opposite edges.

77. The method of claim 76, wherein the fourth and fifth reinforcements each is a plastic film which covers the opposite edges and adjacent inner and outer sheets of the front and rear covers, respectively.

78. The method of claim 77, wherein the opposite edges each have corners, and wherein the fourth and fifth plastic reinforcements are applied to cover the corners.

79. A method for manufacturing reinforced divider folders having extended useful service lives, which comprises:

determining at least two critical areas of the folders which are prone to wear and tear; and applying separate plastic reinforcements upon or adjacent to at least two critical areas of the folder to form laminates therewith for increasing the strength and resistance of the folder to wear and tear;

wherein the folder includes a rigid sheet of material having a score line that defines a flap portion and a backboard portion, the backboard portion having two holes therein that are aligned with two holes in the flap portion, the holes being configured and dimensioned to receive a holding mechanism therethrough; and a tab member integrally formed with an edge of the backboned portion that is opposite to the score line; and wherein a first plastic reinforcement in the form of a strip of plastic material is substantially completely disposed along the score line.

80. The method of claim 79, wherein the first plastic reinforcement covers the score line and portions of the flap and backboard adjacent the score line.

81. The method of claim 80, wherein the folder further comprises flap corners, and wherein the first plastic reinforcement extends onto the flap corners.

82. The method of claim 79, wherein the backboard portion has areas which surround the holes therein, and which further comprises applying a second reinforcement in the form of a plastic film which covers the areas surrounding the holes.

83. The method of claim 79, wherein the flap portion has areas which surround the holes therein, and which further comprises applying a third plastic reinforcement in the form of a plastic film which covers the areas surrounding the holes.

84. The method of claim 79, wherein the backboard portion comprises lower corners with inner and outer surfaces, and which further comprises applying a fourth reinforcement in the form of a plastic film on the inner and outer surfaces of the lower corners.

* * * * *